US008979635B2

(12) United States Patent
Vann et al.

(10) Patent No.: US 8,979,635 B2
(45) Date of Patent: Mar. 17, 2015

(54) SYSTEMS, METHODS AND DEVICES FOR PLAYING WAGERING GAMES WITH DISTRIBUTED AND SHARED PARTIAL OUTCOME FEATURES

(71) Applicant: WMS Gaming Inc., Waukegan, IL (US)

(72) Inventors: Jamie W. Vann, Chicago, IL (US); Andrew C. Guinn, Chicago, IL (US); Damon Gura, Chicago, IL (US); Richard B. Robbins, Glenview, IL (US)

(73) Assignee: WMS Gaming Inc., Waukegan, IL (US)

( * ) Notice: Subject to any disclaimer, the term of this patent is extended or adjusted under 35 U.S.C. 154(b) by 129 days.

(21) Appl. No.: 13/760,520

(22) Filed: Feb. 6, 2013

(65) Prior Publication Data

US 2013/0260861 A1 Oct. 3, 2013

Related U.S. Application Data

(60) Provisional application No. 61/618,983, filed on Apr. 2, 2012.

(51) Int. Cl.
*A63F 9/24* (2006.01)
*G07F 17/34* (2006.01)
*G07F 17/32* (2006.01)

(52) U.S. Cl.
CPC ..... *G07F 17/34* (2013.01); *G07F 17/3274* (2013.01)
USPC ..... 463/20; 463/16

(58) Field of Classification Search
CPC . G07F 17/3274; G07F 17/34; G07F 17/3267; G07F 17/3225
USPC ..... 463/16, 20
See application file for complete search history.

(56) References Cited

U.S. PATENT DOCUMENTS 4,527,798 A 7/1985 Siekierski et al.
4,624,459 A 11/1986 Kaufman (Continued)

FOREIGN PATENT DOCUMENTS

CA 2334546 A1 8/2001
DE 195 15 983 A1 11/1996

(Continued)

OTHER PUBLICATIONS

Article for "Easy Riches" by Sigma Game, Strictly Slots, 1 page (Aug. 2001).

(Continued)

*Primary Examiner* — Dmitry Suhol
*Assistant Examiner* — Carl V Larsen
(74) *Attorney, Agent, or Firm* — Nixon Peabody LLP

(57) ABSTRACT

Gaming devices, gaming systems, methods of conducting wagering games, and computer programs for executing wagering games are disclosed. A gaming system for playing a wagering game is disclosed which includes at least one memory device which stores instructions that cause at least one processor to operate with at least one display device and at least one input device to: display a randomly determined partial outcome of the wagering game to a first player; transmit the randomly determined partial outcome to at least one second player; randomly determine a first final outcome of the wagering game for the first player; randomly determine a second final outcome of the wagering game for the second player(s), both of the first and second final outcomes including the partial outcome; and, if at least one of the final outcomes is a winning outcome, award an award associated with the winning outcome.

24 Claims, 9 Drawing Sheets

(56) References Cited

U.S. PATENT DOCUMENTS

| | | | |
|---|---|---|---|
| 4,805,907 | A | 2/1989 | Hagiwara |
| 4,837,728 | A | 6/1989 | Barrie et al. |
| 4,856,787 | A | 8/1989 | Itkis |
| 4,948,134 | A | 8/1990 | Suttle et al. |
| 5,116,055 | A | 5/1992 | Tracy |
| 5,249,800 | A | 10/1993 | Hilgendorf et al. |
| 5,275,400 | A | 1/1994 | Weingardt et al. |
| 5,280,909 | A | 1/1994 | Tracy |
| 5,299,803 | A | 4/1994 | Halaby |
| 5,344,144 | A | 9/1994 | Canon |
| 5,377,973 | A | 1/1995 | Jones et al. |
| 5,393,057 | A | 2/1995 | Marnell |
| 5,397,133 | A | 3/1995 | Penzias |
| 5,470,079 | A | 11/1995 | LeStrange et al. |
| 5,489,103 | A | 2/1996 | Okamoto |
| 5,524,888 | A | 6/1996 | Heidel |
| 5,544,892 | A | 8/1996 | Breeding |
| 5,564,700 | A | 10/1996 | Celona |
| 5,580,063 | A | 12/1996 | Edwards |
| 5,580,309 | A | 12/1996 | Piechowiak et al. |
| 5,586,937 | A | 12/1996 | Menashe |
| 5,611,730 | A | 3/1997 | Weiss |
| 5,645,486 | A | 7/1997 | Nagao et al. |
| 5,655,961 | A | 8/1997 | Acres et al. |
| 5,674,128 | A | 10/1997 | Holch et al. |
| 5,707,286 | A | 1/1998 | Carlson |
| 5,759,102 | A | 6/1998 | Pease et al. |
| 5,762,552 | A | 6/1998 | Vuong et al. |
| 5,766,076 | A | 6/1998 | Pease et al. |
| 5,770,533 | A | 6/1998 | Franchi |
| 5,772,509 | A | 6/1998 | Weiss |
| RE35,864 | E | 7/1998 | Weingardt |
| 5,779,549 | A | 7/1998 | Walker et al. |
| 5,797,794 | A | 8/1998 | Angell |
| 5,800,268 | A | 9/1998 | Molnick |
| 5,816,918 | A | 10/1998 | Kelly et al. |
| 5,823,874 | A | 10/1998 | Adams |
| 5,823,879 | A | 10/1998 | Goldberg et al. |
| 5,830,063 | A | 11/1998 | Byrne |
| 5,830,069 | A | 11/1998 | Soltesz et al. |
| 5,842,698 | A | 12/1998 | Brown |
| 5,848,932 | A | 12/1998 | Adams |
| 5,851,011 | A | 12/1998 | Lott |
| 5,851,149 | A | 12/1998 | Xidos et al. |
| 5,855,515 | A | 1/1999 | Pease et al. |
| 5,876,284 | A | 3/1999 | Acres et al. |
| 5,885,158 | A | 3/1999 | Torango et al. |
| 5,909,486 | A | 6/1999 | Walker et al. |
| 5,941,773 | A | 8/1999 | Harlick |
| 5,971,271 | A | 10/1999 | Wynn et al. |
| 5,971,849 | A | 10/1999 | Falciglia |
| 5,997,400 | A | 12/1999 | Seelig et al. |
| 6,001,016 | A | 12/1999 | Walker et al. |
| 6,004,205 | A | 12/1999 | Lauretta et al. |
| 6,007,427 | A | 12/1999 | Wiener et al. |
| 6,012,982 | A | 1/2000 | Piechowiak et al. |
| 6,012,983 | A | 1/2000 | Walker et al. |
| 6,012,984 | A | 1/2000 | Roseman |
| 6,026,433 | A | 2/2000 | D'Arlach et al. |
| 6,039,648 | A | 3/2000 | Guinn et al. |
| 6,047,963 | A | 4/2000 | Pierce et al. |
| 6,077,162 | A | 6/2000 | Weiss |
| 6,089,977 | A | 7/2000 | Bennett |
| 6,089,980 | A | 7/2000 | Gauselmann |
| 6,102,474 | A | 8/2000 | Daley |
| 6,102,798 | A | 8/2000 | Bennett |
| 6,102,799 | A | 8/2000 | Stupak |
| 6,104,815 | A | 8/2000 | Alcorn et al. |
| 6,110,043 | A | 8/2000 | Olsen |
| 6,117,011 | A | 9/2000 | Lvov |
| 6,135,887 | A | 10/2000 | Pease et al. |
| 6,139,013 | A | 10/2000 | Pierce et al. |
| 6,142,872 | A | 11/2000 | Walker et al. |
| 6,146,273 | A | 11/2000 | Olsen |
| 6,149,522 | A | 11/2000 | Alcorn et al. |
| 6,155,925 | A | 12/2000 | Giobbi et al. |
| 6,158,741 | A | 12/2000 | Koelling |
| 6,159,097 | A | 12/2000 | Gura |
| 6,164,651 | A | 12/2000 | Webb |
| 6,168,523 | B1 | 1/2001 | Piechowiak et al. |
| 6,183,362 | B1 | 2/2001 | Boushy |
| 6,183,366 | B1 | 2/2001 | Goldberg et al. |
| 6,203,010 | B1 | 3/2001 | Jorasch et al. |
| 6,204,560 | B1 | 3/2001 | Daetwyler et al. |
| 6,206,374 | B1 | 3/2001 | Jones |
| 6,206,782 | B1 | 3/2001 | Walker et al. |
| 6,210,274 | B1 | 4/2001 | Carlson |
| 6,210,275 | B1 | 4/2001 | Olsen |
| 6,210,277 | B1 | 4/2001 | Stefan |
| 6,217,448 | B1 | 4/2001 | Olsen |
| 6,220,593 | B1 | 4/2001 | Pierce et al. |
| 6,224,482 | B1 | 5/2001 | Bennett |
| 6,224,484 | B1 | 5/2001 | Okuda et al. |
| 6,231,445 | B1 | 5/2001 | Acres |
| 6,254,483 | B1 | 7/2001 | Acres |
| 6,264,557 | B1 | 7/2001 | Schneier et al. |
| 6,264,561 | B1 | 7/2001 | Saffari et al. |
| 6,272,223 | B1 | 8/2001 | Carlson |
| 6,273,821 | B1 | 8/2001 | Moriguchi |
| 6,286,003 | B1 | 9/2001 | Muta |
| 6,308,953 | B1 | 10/2001 | Nagano |
| 6,309,299 | B1 | 10/2001 | Weiss |
| 6,312,332 | B1 | 11/2001 | Walker et al. |
| 6,315,660 | B1 | 11/2001 | DeMar et al. |
| 6,319,125 | B1 | 11/2001 | Acres |
| 6,319,127 | B1 | 11/2001 | Walker et al. |
| 6,334,104 | B1 | 12/2001 | Hirai |
| 6,336,859 | B2 | 1/2002 | Jones et al. |
| 6,336,862 | B1 | 1/2002 | Byrne |
| 6,345,824 | B1 | 2/2002 | Selitzky |
| 6,346,048 | B1 | 2/2002 | Ogawa et al. |
| 6,358,149 | B1 | 3/2002 | Schneider et al. |
| 6,361,441 | B1 | 3/2002 | Walker et al. |
| 6,364,768 | B1 | 4/2002 | Acres et al. |
| 6,375,567 | B1 | 4/2002 | Acres |
| 6,375,568 | B1 | 4/2002 | Roffman et al. |
| 6,402,618 | B1 | 6/2002 | Reed et al. |
| 6,406,371 | B1 | 6/2002 | Baba et al. |
| 6,409,602 | B1 | 6/2002 | Wiltshire et al. |
| 6,416,408 | B2 | 7/2002 | Tracy et al. |
| 6,416,409 | B1 | 7/2002 | Jordan |
| 6,422,940 | B1 | 7/2002 | Walker et al. |
| 6,431,983 | B2 | 8/2002 | Acres |
| 6,434,398 | B1 | 8/2002 | Inselberg |
| 6,435,968 | B1 | 8/2002 | Torango |
| 6,439,995 | B1 | 8/2002 | Hughs-Baird et al. |
| 6,454,650 | B1 | 9/2002 | Aronin |
| 6,482,089 | B2 | 11/2002 | DeMar et al. |
| 6,488,580 | B1 | 12/2002 | Robb |
| 6,503,146 | B2 | 1/2003 | Walker et al. |
| 6,506,117 | B2 | 1/2003 | DeMar et al. |
| 6,508,707 | B2 | 1/2003 | DeMar et al. |
| 6,508,709 | B1 | 1/2003 | Karmarkar |
| 6,508,710 | B1 | 1/2003 | Paravia et al. |
| 6,517,073 | B1 | 2/2003 | Vancura |
| 6,517,433 | B2 | 2/2003 | Loose et al. |
| 6,520,855 | B2 | 2/2003 | DeMar et al. |
| 6,523,124 | B1 | 2/2003 | Lunsford et al. |
| 6,560,639 | B1 | 5/2003 | Dan et al. |
| 6,589,115 | B2 | 7/2003 | Walker et al. |
| 6,592,460 | B2 | 7/2003 | Torango |
| 6,599,186 | B1 | 7/2003 | Walker et al. |
| 6,599,188 | B2 | 7/2003 | Hirsch et al. |
| 6,599,193 | B2 | 7/2003 | Baerlocher et al. |
| 6,648,753 | B1 | 11/2003 | Tracy et al. |
| 6,648,762 | B2 | 11/2003 | Walker et al. |
| 6,652,378 | B2 | 11/2003 | Cannon et al. |
| 6,692,354 | B2 | 2/2004 | Tracy et al. |
| 6,712,695 | B2 | 3/2004 | Mothwurf et al. |
| 6,712,699 | B2 | 3/2004 | Walker et al. |
| 6,733,390 | B2 | 5/2004 | Walker et al. |
| 6,749,510 | B2 | 6/2004 | Giobbi |
| 6,755,741 | B1 | 6/2004 | Rafaeli |
| 6,790,141 | B2 | 9/2004 | Muir |

(56) References Cited

U.S. PATENT DOCUMENTS

| | | | |
|---|---|---|---|
| 6,805,634 | B1 | 10/2004 | Wells et al. |
| 6,837,788 | B2 | 1/2005 | Cannon |
| 6,837,793 | B2 | 1/2005 | McClintic |
| 6,860,810 | B2 | 3/2005 | Cannon et al. |
| 6,869,361 | B2 | 3/2005 | Sharpless et al. |
| 6,955,604 | B1 | 10/2005 | Graves et al. |
| 6,986,055 | B2 | 1/2006 | Carlson |
| 7,008,319 | B2 | 3/2006 | Montgomery et al. |
| 7,083,520 | B2 | 8/2006 | Rowe |
| 7,097,562 | B2 | 8/2006 | Gagner |
| 7,169,041 | B2 | 1/2007 | Tessmer et al. |
| 7,175,527 | B2 | 2/2007 | Bryant |
| 7,192,351 | B2 | 3/2007 | Rozkin et al. |
| 7,260,834 | B1 | 8/2007 | Carlson |
| 7,311,598 | B2 | 12/2007 | Kaminkow et al. |
| 7,311,604 | B2 | 12/2007 | Kaminkow et al. |
| 7,347,775 | B2 | 3/2008 | Roemer |
| 7,427,236 | B2 | 9/2008 | Kaminkow et al. |
| 7,448,949 | B2 | 11/2008 | Kaminkow et al. |
| 7,476,153 | B2 | 1/2009 | Walker et al. |
| 7,662,040 | B2 | 2/2010 | Englman et al. |
| 7,666,092 | B2 | 2/2010 | Kaminkow et al. |
| 7,775,873 | B2 | 8/2010 | Aoki et al. |
| 7,780,531 | B2 | 8/2010 | Englman et al. |
| 7,833,094 | B2 | 11/2010 | Englman et al. |
| 7,854,654 | B2 | 12/2010 | Baerlocher et al. |
| 7,892,093 | B2 | 2/2011 | Kniesteadt et al. |
| 7,931,530 | B2 | 4/2011 | Anderson et al. |
| 7,963,847 | B2 | 6/2011 | Baerlocher |
| 7,980,954 | B2 | 7/2011 | Gagner et al. |
| 8,216,048 | B2 | 7/2012 | Cowan et al. |
| 8,262,456 | B2 | 9/2012 | Englman et al. |
| 8,292,731 | B2 | 10/2012 | Collette et al. |
| 8,303,402 | B2 | 11/2012 | Aoki et al. |
| 8,409,014 | B2 | 4/2013 | Gagner et al. |
| 8,449,387 | B2 | 5/2013 | Englman et al. |
| 2001/0004606 | A1 | 6/2001 | Tracy et al. |
| 2001/0044339 | A1 | 11/2001 | Cordero et al. |
| 2002/0002073 | A1 | 1/2002 | Montgomery et al. |
| 2002/0006822 | A1 | 1/2002 | Krintzman |
| 2002/0025845 | A1 | 2/2002 | Cannon |
| 2002/0032049 | A1 | 3/2002 | Walker et al. |
| 2002/0037767 | A1 | 3/2002 | Ebin |
| 2002/0073043 | A1 | 6/2002 | Herman et al. |
| 2002/0087876 | A1 | 7/2002 | Larose |
| 2002/0107072 | A1 | 8/2002 | Giobbi |
| 2002/0116615 | A1 | 8/2002 | Nguyen et al. |
| 2002/0138594 | A1 | 9/2002 | Rowe |
| 2002/0142846 | A1 | 10/2002 | Paulsen |
| 2002/0147047 | A1 | 10/2002 | Letovsky et al. |
| 2002/0151345 | A1 | 10/2002 | Byrne |
| 2002/0151349 | A1 | 10/2002 | Joshi |
| 2002/0155874 | A1 | 10/2002 | Byrne |
| 2002/0163778 | A1 | 11/2002 | Hazzard et al. |
| 2002/0183105 | A1 | 12/2002 | Cannon et al. |
| 2003/0027618 | A1 | 2/2003 | Byrne |
| 2003/0028567 | A1 | 2/2003 | Carlson |
| 2003/0036430 | A1 | 2/2003 | Cannon |
| 2003/0045337 | A1 | 3/2003 | Byrne |
| 2003/0050106 | A1 | 3/2003 | Lyfoung |
| 2003/0060258 | A1 | 3/2003 | Coleman et al. |
| 2003/0064771 | A1 | 4/2003 | Morrow et al. |
| 2003/0064776 | A1 | 4/2003 | Byrne |
| 2003/0064805 | A1 | 4/2003 | Wells |
| 2003/0064807 | A1 | 4/2003 | Walker et al. |
| 2003/0092485 | A1 | 5/2003 | Seelig et al. |
| 2003/0100361 | A1 | 5/2003 | Sharpless et al. |
| 2003/0114220 | A1 | 6/2003 | McClintic |
| 2003/0119581 | A1 | 6/2003 | Cannon et al. |
| 2003/0148804 | A1 | 8/2003 | Ikeya et al. |
| 2003/0148807 | A1 | 8/2003 | Acres |
| 2003/0148808 | A1 | 8/2003 | Price |
| 2003/0162589 | A1 | 8/2003 | Nguyen et al. |
| 2003/0181231 | A1 | 9/2003 | Vancura et al. |
| 2003/0186733 | A1 | 10/2003 | Wolf et al. |
| 2003/0195043 | A1 | 10/2003 | Shinners et al. |
| 2003/0216166 | A1 | 11/2003 | Baerlocher et al. |
| 2003/0222402 | A1 | 12/2003 | Olive |
| 2003/0224852 | A1* | 12/2003 | Walker et al. ..... 463/20 |
| 2003/0228899 | A1 | 12/2003 | Evans |
| 2003/0236116 | A1 | 12/2003 | Marks et al. |
| 2004/0009808 | A1 | 1/2004 | Gauselmann |
| 2004/0009811 | A1 | 1/2004 | Torango |
| 2004/0030654 | A1 | 2/2004 | Walker et al. |
| 2004/0038741 | A1 | 2/2004 | Gauselmann |
| 2004/0048644 | A1 | 3/2004 | Gerrard et al. |
| 2004/0053657 | A1 | 3/2004 | Fiden et al. |
| 2004/0102243 | A1 | 5/2004 | Olsen |
| 2004/0106448 | A1 | 6/2004 | Gauselmann |
| 2004/0204226 | A1 | 10/2004 | Foster et al. |
| 2004/0204235 | A1 | 10/2004 | Walker et al. |
| 2004/0209660 | A1 | 10/2004 | Carlson et al. |
| 2004/0235552 | A1 | 11/2004 | Gauselmann |
| 2004/0242297 | A1 | 12/2004 | Walker et al. |
| 2004/0242303 | A1 | 12/2004 | Walker et al. |
| 2004/0248651 | A1 | 12/2004 | Gagner |
| 2005/0014554 | A1 | 1/2005 | Walker et al. |
| 2005/0020340 | A1 | 1/2005 | Cannon |
| 2005/0026674 | A1 | 2/2005 | Wolf et al. |
| 2005/0055113 | A1 | 3/2005 | Gauselmann |
| 2005/0124406 | A1 | 6/2005 | Cannon |
| 2005/0130730 | A1 | 6/2005 | Lind et al. |
| 2005/0192086 | A1 | 9/2005 | Walker et al. |
| 2005/0193209 | A1 | 9/2005 | Saunders et al. |
| 2005/0282605 | A1 | 12/2005 | Englman |
| 2006/0019734 | A1 | 1/2006 | Roemer |
| 2006/0019744 | A1 | 1/2006 | Roemer |
| 2006/0040732 | A1 | 2/2006 | Baerlocher et al. |
| 2006/0079318 | A1 | 4/2006 | Aoki et al. |
| 2006/0079319 | A1 | 4/2006 | Aoki et al. |
| 2006/0084486 | A1 | 4/2006 | Belger et al. |
| 2006/0121971 | A1 | 6/2006 | Slomiany et al. |
| 2006/0135243 | A1 | 6/2006 | Englman |
| 2006/0160625 | A1 | 7/2006 | Englman et al. |
| 2006/0165235 | A1 | 7/2006 | Carlson |
| 2006/0223611 | A1 | 10/2006 | Baerlocher |
| 2008/0020847 | A1 | 1/2008 | Kniesteadt et al. |
| 2008/0045341 | A1 | 2/2008 | Englman |
| 2008/0070702 | A1 | 3/2008 | Kaminkow et al. |
| 2008/0081690 | A1 | 4/2008 | Baerlocher et al. |
| 2008/0113771 | A1 | 5/2008 | Baerlocher et al. |
| 2008/0139290 | A1 | 6/2008 | Kniesteadt et al. |
| 2008/0153564 | A1 | 6/2008 | Baerlocher et al. |
| 2009/0093298 | A1 | 4/2009 | Michel |
| 2009/0118016 | A1* | 5/2009 | Ben-Artzi et al. ..... 463/42 |
| 2009/0124366 | A1 | 5/2009 | Aoki et al. |
| 2009/0305765 | A1 | 12/2009 | Walker et al. |
| 2010/0137047 | A1 | 6/2010 | Englman et al. |
| 2010/0197385 | A1* | 8/2010 | Aoki et al. ..... 463/27 |
| 2010/0291991 | A1 | 11/2010 | Baerlocher et al. |
| 2010/0304843 | A1 | 12/2010 | Aoki et al. |
| 2011/0053683 | A1 | 3/2011 | Aoki et al. |
| 2011/0105233 | A1 | 5/2011 | Aoki |
| 2011/0312410 | A1 | 12/2011 | Aoki et al. |
| 2013/0116028 | A1 | 5/2013 | Aoki et al. |

FOREIGN PATENT DOCUMENTS

| | | | |
|---|---|---|---|
| DE | 196 24 321 | A1 | 1/1998 |
| EP | 0507435 | | 10/1992 |
| EP | 0 521 599 | A1 | 1/1993 |
| EP | 0829834 | A2 | 3/1998 |
| EP | 0843272 | A1 | 5/1998 |
| EP | 1 513 114 | A2 | 3/2005 |
| EP | 1 564 698 | A2 | 8/2005 |
| EP | 1 762 990 | A2 | 3/2007 |
| GB | 2117546 | | 10/1983 |
| GB | 2148037 | | 5/1985 |
| GB | 2 153 572 | A | 8/1985 |
| GB | 2 181 589 | A | 4/1987 |
| GB | 2 242 300 | A | 9/1991 |
| GB | 2 313 792 | A | 10/1997 |
| GB | 2 333 880 | | 8/1999 |
| WO | WO 97/27569 | | 7/1997 |

(56) References Cited

FOREIGN PATENT DOCUMENTS

| | | | | |
|---|---|---|---|---|
| WO | WO 99/03078 | A1 | 1/1999 | |
| WO | WO 99/19037 | A1 | 4/1999 | |
| WO | WO 01/33478 | A1 | 5/2001 | |
| WO | WO 01/91866 | | 12/2001 | |
| WO | WO 03/026754 | A1 | 4/2003 | |
| WO | WO 03/083789 | A1 | 10/2003 | |
| WO | WO 2004/034223 | A2 | 4/2004 | |
| WO | WO 2006/015442 | A1 | 2/2006 | |
| WO | WO 2009/114472 | A1 | 9/2009 | |
| WO | WO-2010/042375 | A1 * | 4/2010 | ..... A63F 9/24 |

OTHER PUBLICATIONS

Article for "Millioniser" by Glenn Haussman, Strictly Slots, pp. 50-53 (Mar. 2004).

International Search Report corresponding to International Patent Application No. PCT/US2008/005032, United States Patent Office, dated Aug. 11, 2008, 4 pages.

International Search Report corresponding to International Patent Application No. PCT/US2008/012433, United States Patent Office, dated Jan. 2, 2009, 5 pages.

"New '97 Games," International Gaming & Wagering Business, 24 pages (Mar. 1997).

Product Sheet for "Big Games Safari," IGT, 24 pages (2000).

"The Silicon Gaming Odyssey Slot Machine" (Levinthal,, et al., pp. 296 to 301, 1063-6390/97, © IEEE, Proceedings of COMPCON 97).

Written Opinion corresponding to co-pending International Patent Application Serial No. PCT/US2008/005032, European Patent Office; dated Aug. 11, 2008; 6 pages.

Written Opinion corresponding to International Patent Application No. PCT/US2008/012433, United States Patent Office, dated Jan. 2, 2009, 2 pages.

* cited by examiner

SYSTEMS, METHODS AND DEVICES FOR PLAYING WAGERING GAMES WITH DISTRIBUTED AND SHARED PARTIAL OUTCOME FEATURES

CLAIM OF PRIORITY AND CROSS-REFERENCE TO RELATED APPLICATION

This application claims the benefit of and priority to U.S. Provisional Patent Application No. 61/618,983, which was filed on Apr. 2, 2012, and is incorporated herein by reference in its entirety.

COPYRIGHT

A portion of the disclosure of this patent document contains material which is subject to copyright protection. The copyright owner has no objection to the facsimile reproduction by anyone of the patent disclosure as it appears in the U.S. Patent and Trademark Office patent files or records, but otherwise reserves all copyright rights whatsoever.

TECHNICAL FIELD

The present disclosure relates generally to wagering games, as well as wagering game terminals and gaming systems. More particularly, the present disclosure relates to systems, methods, and devices for playing wagering games with game features that are shared among multiple players.

BACKGROUND

Gaming terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Thus, gaming manufacturers continuously strive to develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "primary" or "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio.

Another concept that has been employed is the use of progressive jackpots. In the gaming industry, a "progressive jackpot" involves collecting coin-in data from participating gaming device(s) (e.g., slot machines), contributing a percentage of that coin-in data to a jackpot amount, and awarding that jackpot amount to a player upon the occurrence of a jackpot-winning event. A jackpot-winning event typically occurs when a "progressive winning position" is achieved at a participating gaming device. If the gaming device is a slot machine, a progressive winning position may, for example, correspond to alignment of progressive jackpot reel symbols along an active payline. The initial progressive jackpot is a predetermined minimum amount. That jackpot amount, however, progressively increases as players continue to play the gaming machine without winning the jackpot. Further, when several gaming machines are linked together such that several players at several gaming machines compete for the same jackpot, the jackpot progressively increases at a much faster rate.

Game play, whether it is a basic game, a bonus game, or progressive gaming, is typically a function of player activity at a single gaming terminal. Consequently, individual players are rarely interested in game play of other players at other gaming terminals, especially those that are not within view. Recent enhancements to available gaming features, such as community gaming events, allow players to share in gaming activities with other gaming terminals. For example, game play of a community game at one gaming terminal in a bank of terminals may influence game play of the community game at another gaming terminal within that terminal bank. Providing shared gaming experiences allows players to participate in an arena larger than his or her personal gaming terminal. Additional information regarding community gaming can be found, for example, in commonly owned U.S. Patent Application Publication No. 2010/0317442 A1, to Alfred Thomas et al., which published on Dec. 16, 2010, and is incorporated herein by reference in its entirety and for all purposes.

Interactive online gaming allows players to gamble from locations remote from a casino. For example, a player may access a gaming web site on a global computer network, such as the Internet, from a computing device coupled to the global computer network. The computing device may, for example, be a personal computer, Internet appliance, personal digital assistant, or wireless telephone. To play a wagering game on the gaming web site, a player generally must supply credit or debit card account information. Wagers are deducted from the account, and payouts for winning outcomes are added to the account. Additional information regarding online gaming can be found, for example, in commonly owned U.S. Pat. No. 7,722,466 B2, to Wayne H. Rothschild, which issued on May 25, 2010, and is incorporated herein by reference in its entirety and for all purposes.

While some current game features provide some enhanced excitement, there is still a need for additional concepts to enhance the entertainment value of electronic wagering games, such as slots, keno, poker, and blackjack. Although a lot of focus is now being paid to enhancing bonus games, there is still room for improving aspects of the basic wagering game. Such new features for wagering games will further enhance player excitement, perpetuate player loyalty, and thus increase game play and profitability.

SUMMARY

Aspects of the present disclosure are directed to a wagering game with a game outcome sharing feature that allows a player to garner more chances of achieving a desired outcome by using their social network of friends. During game play, for example, when a partial outcome is triggered—e.g., by two bonus-triggering symbols on the first 2, 3 or 4 reels in a base game spin; by 3- or 4-to-a-royal in a hand of poker; a qualifying pick made in a picking game, etc., the game is suspended and the final outcome is not revealed until after the player has had a chance to send the partial outcome to another player or group of players. After the partial outcome has been sent, the remainder of the game outcome is revealed, and the player receives any awards associated with that outcome. When a second player chooses to complete the partial outcome, a new RNG-generated result determines a final outcome of the second player's game, which is starts from the shared partial outcome. Any winning outcome the second player receives is awarded not only to the second player, but is also sent back to the originating player. Thus, the more friends with whom the player shares the partial outcome, the more chances the player has of achieving a desired outcome. This feature capitalizes on social networking websites and incentivizes players to involve friends who may not otherwise have been playing. In a social gaming space, this can create a viral phenomenon (or "virality") by being able to transmit, distribute, share, auction, and/or sell partial outcomes within such a large community.

A specific example of the above aspects may include: Player A initiates a slot game with five reels; Player A receives two bonus-game-triggering symbols aligned along an active payline on reels 1 and 2; game play is suspended while reels 3, 4 and 5 continue spinning; Player A can choose to send the partial outcome (stopped reels 1 and 2; spinning reels 3-5) to Player B, which may require Player A to deposit additional credits (a "side wager") to share the partial outcome; Player A completes the rest of the game outcome—reels 3-5 stop; the completed outcome does not include the requisite number of bonus-game-triggering symbols and does not include any line wins; Player B is notified (e.g., via a posting on a social networking website) that Player A sent a request to "Finish My Spin"; Player B chooses to complete Player A's partial outcome, which may require Player B to deposit credits (a "second wager"); Player B's final outcome starts with Player A's partial outcome, i.e., with stopped reels 1 and 2 with the two bonus-game-triggering symbols, and completes the spin of reels 3-5 based on a separate random number generated result; Player B's separately RNG-determined final outcome includes two more bonus-game-triggering symbols on reels 3 and 4, triggering a secondary bonus game; Player B plays the secondary bonus game; the bonus-game-triggering result from Player B's game is sent back to Player A; Player A is notified of Player B's outcome, which triggers a secondary bonus game for Player A that is played independent of Player B's secondary bonus game.

According to one aspect of the present disclosure, a gaming system for playing a wagering game is disclosed. The gaming system includes at least one input device, at least one display device, and at least one processor. The gaming system also includes at least one memory device which stores instructions that cause the at least one processor to operate with the at least one display device and the at least one input device to: display a randomly determined partial outcome of the wagering game to a first player; transmit the randomly determined partial outcome to at least one second player; randomly determine a first final outcome of the wagering game for the first player, the first final outcome including the partial outcome; randomly determine a second final outcome of the wagering game for the at least one second player, the second final outcome including the partial outcome; and, if at least one of the first and second final outcomes is a winning outcome, award an award associated with the winning outcome.

Other aspects of the present disclosure are directed to a method of conducting a wagering game on a gaming system with at least one input device, at least one display device, and at least one processor. The method includes: receiving, via the at least one input device, an indication of a wager; displaying, via the at least one display device, a randomly determined partial outcome of the wagering game to a first player; transmitting the randomly determined partial outcome to at least one second player; randomly determining a first final outcome of the wagering game for the first player, the first final outcome including the partial outcome; randomly determining a second final outcome of the wagering game for the at least one second player, the second final outcome including the partial outcome; and, if at least one of the final outcomes is a winning outcome, awarding an award associated with the winning outcome.

In accordance with another aspect of the disclosure, a computer program product is disclosed which includes one or more non-transient computer-readable media with instructions which, when executed by one or more processors, cause the one or more processors to operate with one or more input devices and one or more display devices to: receive an indication of a wager to play the wagering game; direct the one or more display devices to display a randomly determined partial outcome of the wagering game to a first player; transmit the randomly determined partial outcome to at least one second player; randomly determine a first final outcome of the wagering game for the first player, the first final outcome including the partial outcome; randomly determine a second final outcome of the wagering game for the at least one second player, the second final outcome including the partial outcome; and, if at least one of the final outcomes is a winning outcome, award an award associated with the winning outcome.

Another aspect of this disclosure is directed to a gaming system for playing a wagering game. The gaming system includes, inter alia, at least one input device, at least one display device, at least one processor, and at least one memory device. The memory device(s) stores instructions which, when executed by the processor(s), cause the gaming system to: receive a first wager from a first player to play the wagering game; display a portion of a first outcome of the wagering game, the first outcome being randomly determined from a plurality of possible game outcomes and being represented by a first plurality of symbols, the displayed portion including some but not all of the first plurality of symbols; in response to the displayed portion of the first outcome including at least a portion of a winning symbol combination but not including any complete winning symbol combinations, and prior to displaying all of the first outcome, transmit the portion of the first outcome to a plurality of additional players with an option to complete the portion as part of a separate outcome of the wagering game; in response to at least one of the additional players electing to complete the portion of the first outcome, randomly determine a second outcome of the wagering game, the second outcome being represented by a second plurality of symbols including the symbols of the portion of the first outcome; and, in response to at least one of the first and second outcomes includes the winning symbol combination, award to the first player at least a portion of an award associated with the winning symbol combination.

Yet another aspect of this disclosure presents a computer-implemented method of conducting a wagering game on a gaming system with at least one input device, at least one display device, and at least one processor. The method includes: receiving, via the at least one input device, an indication of a wager; determining a first outcome of the wagering game, the first outcome being randomly determined from a plurality of possible game outcomes and being represented by a first plurality of symbols; displaying, via the at least one display device, a portion of the first outcome of the wagering game, the displayed portion including some but not all of the first plurality of symbols; in response to the displayed portion of the first outcome including at least a portion of a winning symbol combination but not including any complete winning symbol combinations, and prior to displaying all of the first outcome, transmitting the portion of the first outcome to a plurality of additional players with an option to complete the portion as part of a separate outcome of the wagering game; in response to at least one of the additional players electing to complete the portion of the first outcome, randomly determining a second outcome of the wagering game, the second outcome being represented by a second plurality of symbols including the symbols of the portion of the first outcome; and in response to at least one of the first and second outcomes includes the winning symbol combination, awarding to the first player at least a portion of an award associated with the winning symbol combination.

The above summary is not intended to represent each embodiment or every aspect of the present disclosure. Rather, the summary merely provides an exemplification of some of the novel features presented herein. The above features and advantages, and other features and advantages of the present disclosure, will be readily apparent from the following detailed description of exemplary embodiments and best modes for carrying out the present invention when taken in connection with the accompanying drawings and the appended claims.

Figure 1:
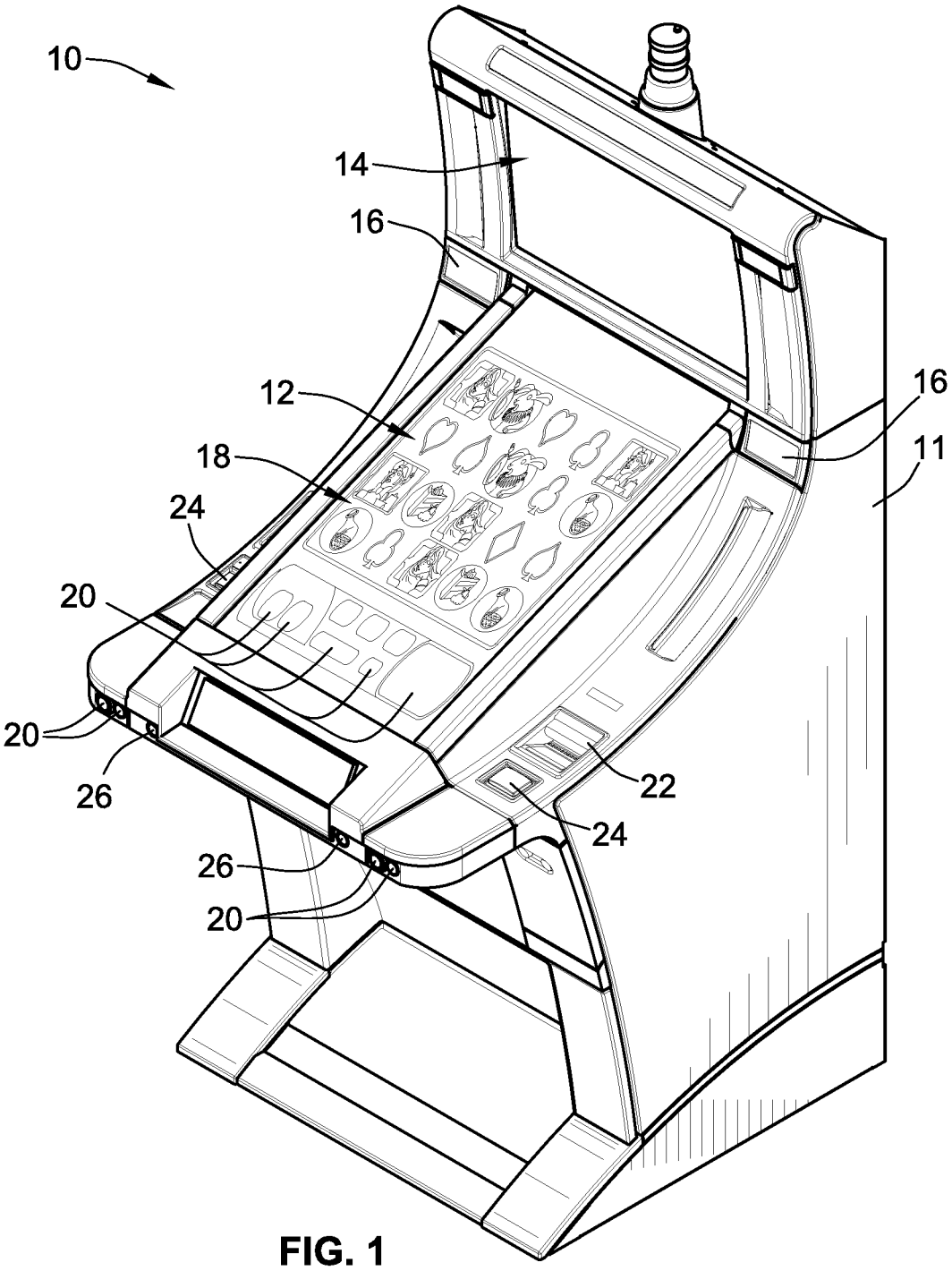
FIG. 1 is a perspective-view illustration of an exemplary free-standing gaming terminal according to aspects of the present disclosure.

While aspects of this disclosure are susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there are shown in the drawings and will herein be described in detail preferred embodiments of the invention with the understanding that the present disclosure is to be considered as an exemplification of the principles of the invention and is not intended to limit the broad aspects of the invention to the embodiments illustrated. To that extent, elements and limitations that are disclosed, for example, in the Abstract, Summary, and Detailed Description sections, but not explicitly set forth in the claims, should not be incorporated into the claims, singly or collectively, by implication, inference or otherwise. For purposes of the present detailed description, unless specifically disclaimed: the singular includes the plural and vice versa; the words "and" and "or" shall be both conjunctive and disjunctive; the word "all" means "any and all"; the word "any" means "any and all"; and the word "including" means "including without limitation." Moreover, words of approximation, such as "about," "almost," "substantially," "approximately," and the like, can be used herein in the sense of "at, near, or nearly at," or "within 3-5% of," or "within acceptable manufacturing tolerances," or any logical combination thereof, for example.

Referring to the drawings, wherein like reference numerals refer to like features throughout the several views, there is shown in FIG. 1 a representative gaming terminal 10 similar to those used in gaming establishments, such as casinos, hotels and cruise ships, and non-conventional gaming establishments, such as airports and restaurants. With regard to the present disclosure, the gaming terminal 10 may be any type of gaming terminal and may have varying structures and methods of operation. For example, in some aspects, the gaming terminal 10 is an electromechanical gaming terminal configured to play slots with mechanical reels, whereas in other aspects, the gaming terminal is an electronic gaming terminal configured to play a video casino game, such as slots, keno, poker, blackjack, roulette, craps, etc. The gaming terminal 10 may take any suitable form, such as floor-standing models (as shown), handheld mobile devices, bartop models, workstation-type console models, etc. Further, the gaming terminal 10 may be primarily dedicated for use in conducting wagering games, or may include non-dedicated devices, such as mobile phones, personal digital assistants, personal computers, etc. Exemplary types of gaming terminals are disclosed in U.S. Pat. No. 6,517,433, U.S. Patent Application Publication Nos. 2010/0062196 and 2010/0234099, and International Application No. PCT/US2007/000792, all of which are incorporated herein by reference in their respective entireties for all purposes.

The gaming terminal 10 illustrated in FIG. 1 comprises a cabinet 11 that may house various input devices, output devices, and input/output devices. By way of non-limiting example, the gaming terminal 10 includes a primary display area 12, a secondary display area 14, and one or more audio speakers 16. The primary display area 12 or the secondary display area 14 may be a mechanical-reel display, a video display, or a combination thereof in which a transmissive video display may be disposed in front of the mechanical-reel display to portray a video image superimposed upon the mechanical-reel display. The display areas may variously display information associated with wagering games, nonwagering games, community games, progressive games, advertisements, services, premium entertainment, text messaging, emails, alerts, announcements, broadcast information, subscription information, etc., appropriate to the particular mode(s) of operation of the gaming terminal 10. The gaming terminal 10 includes a touch screen(s) 18 mounted over the primary and/or secondary areas 12, 14, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming terminal in accord with the present concepts.

Input devices, such as the touch screen 18, buttons 20, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals can be selected from a group consisting essentially of an electrical current, an electrical voltage, an electrical charge, an optical signal, an optical element, a magnetic signal, and a magnetic element.

Figure 2:
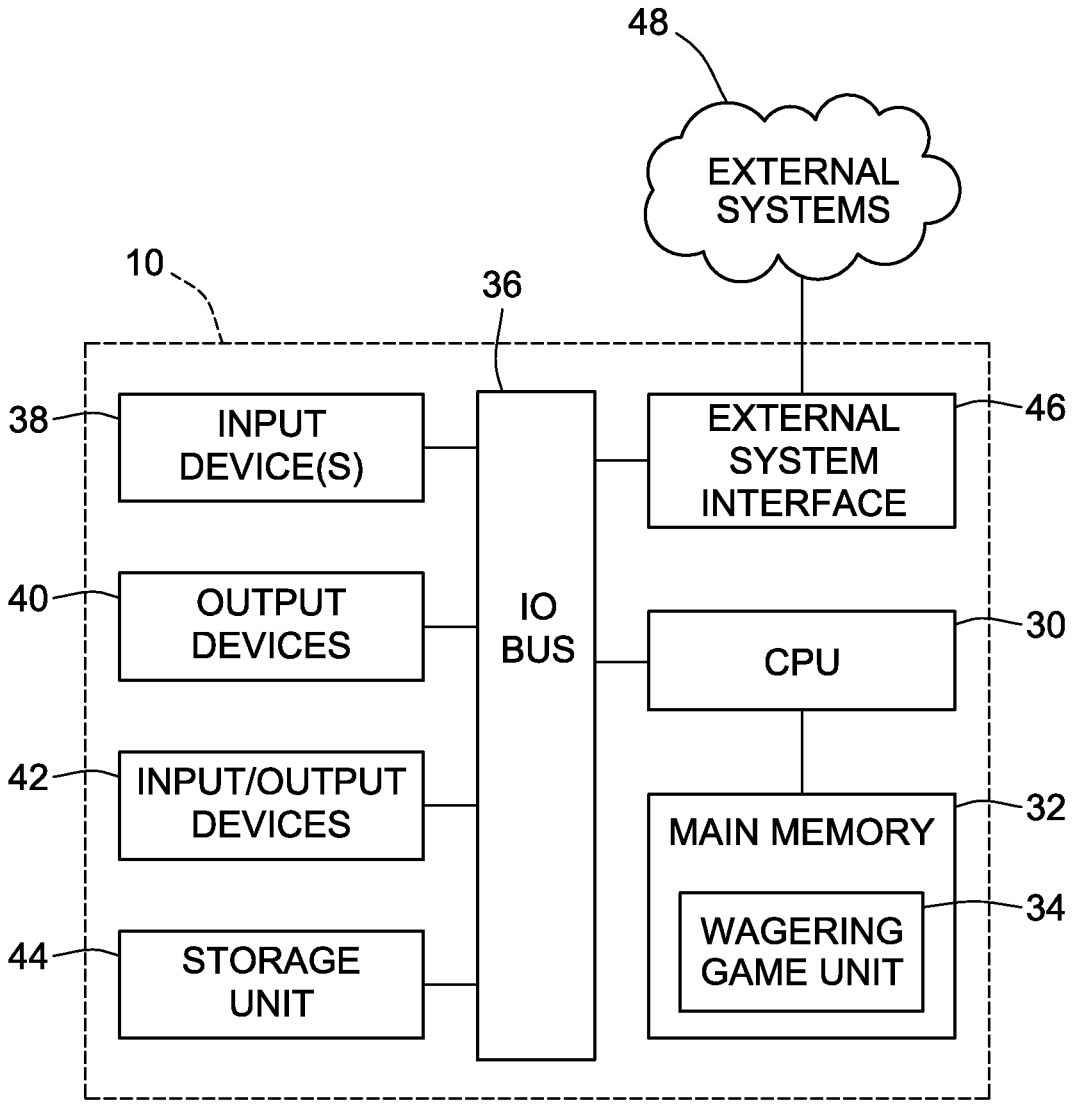
FIG. 2 is a schematic diagram of an example of a gaming system according to aspects of the present disclosure.

Turning now to FIG. 2, there is shown a block diagram of the gaming-terminal architecture. The gaming terminal 10 includes a central processing unit (CPU) 30 connected to a main memory 32. The CPU 30 may include any suitable processor(s), such as those made by Intel and AMD. By way of example, the CPU 30 includes a plurality of microprocessors including a master processor, a slave processor, and a secondary or parallel processor. CPU 30, as used herein, comprises any combination of hardware, software, or firmware disposed in or outside of the gaming terminal 10 that is configured to communicate with or control the transfer of data between the gaming terminal 10 and a bus, another computer, processor, device, service, or network. The CPU 30 comprises one or more controllers or processors and such one or more controllers or processors need not be disposed proximal to one another and may be located in different devices or in different locations. The CPU 30 is operable to execute all of the various gaming methods and other processes disclosed herein. The main memory 32 includes a wagering game unit 34. In one embodiment, the wagering game unit 34 may present wagering games, such as video poker, video black jack, video slots, video lottery, etc., in whole or part.

The CPU 30 is also connected to an input/output (I/O) bus 36, which can include any suitable bus technologies, such as an AGTL+ frontside bus and a PCI backside bus. The I/O bus 36 is connected to various input devices 38, output devices 40, and input/output devices 42 such as those discussed above in connection with FIG. 1. The I/O bus 36 is also connected to storage unit 44 and external system interface 46, which is connected to external system(s) 48 (e.g., wagering game networks).

The external system 48 includes, in various aspects, a gaming network, other gaming terminals, a gaming server, a remote controller, communications hardware, or a variety of other interfaced systems or components, in any combination. In yet other aspects, the external system 48 may comprise a player's portable electronic device (e.g., cellular phone, electronic wallet, etc.) and the external system interface 46 is configured to facilitate wireless communication and data transfer between the portable electronic device and the CPU 30, such as by a near-field communication path operating via magnetic-field induction or a frequency-hopping spread spectrum RF signals (e.g., Bluetooth, etc.).

The gaming terminal 10 optionally communicates with the external system 48 such that the terminal operates as a thin, thick, or intermediate client. In general, a wagering game includes a random number generator (RNG) for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external system 48 ("thin client" gaming terminal), or are distributed therebetween in any suitable manner ("intermediate client" gaming terminal).

The gaming terminal 10 may include additional peripheral devices or more than one of each component shown in FIG. 2. Any component of the gaming terminal architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic disk storage media, optical storage media, flash memory, etc.

Figure 3:
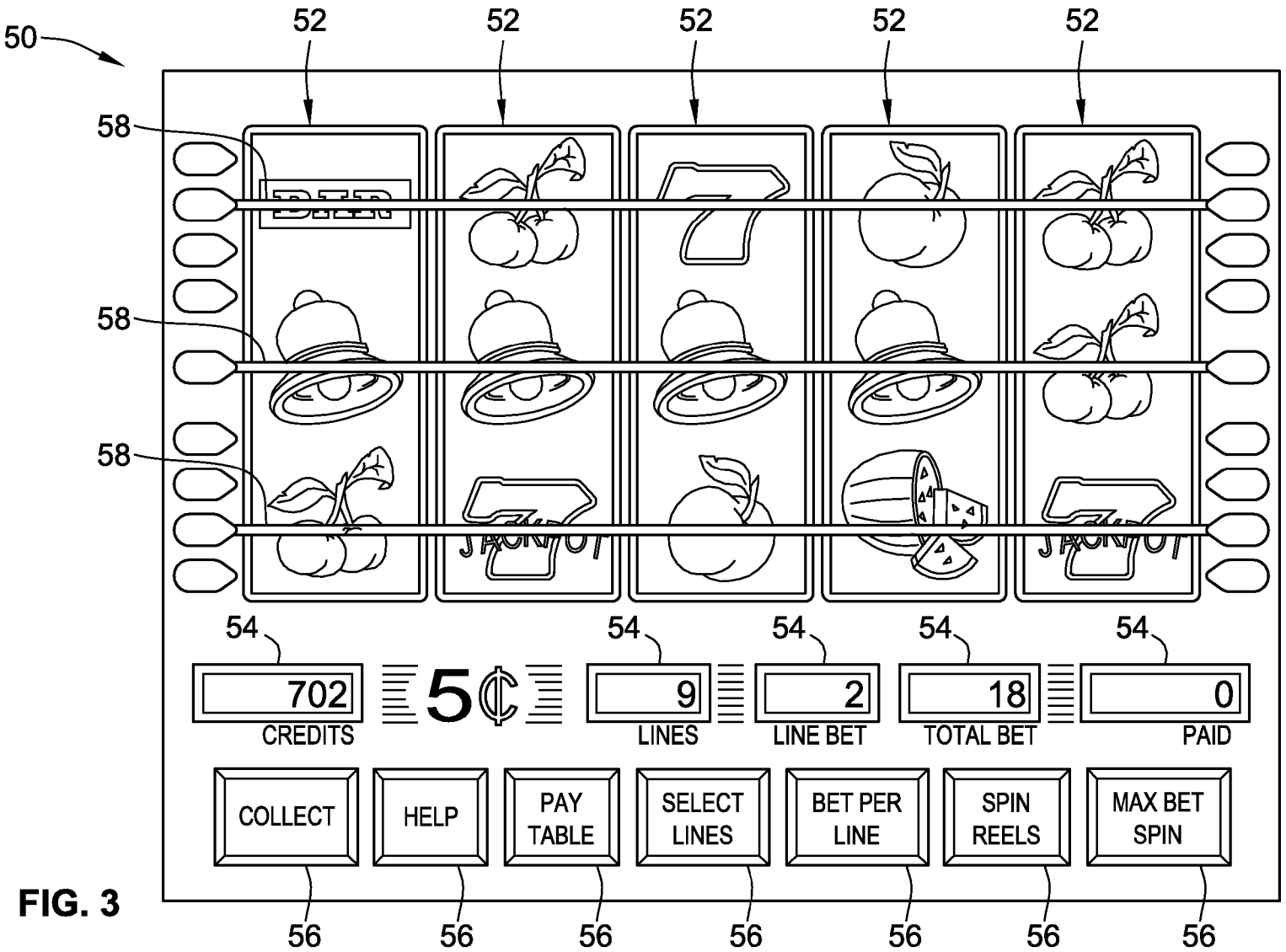
FIG. 3 is a screen shot of a representative basic-game screen of a wagering game displayed on a gaming terminal, gaming device, and/or gaming system according to aspects of the present disclosure.

Referring now to FIG. 3, there is illustrated an image of a basic-game screen 50 adapted to be displayed on the primary display area 12 or the secondary display area 14. The basic-game screen 50 portrays a plurality of simulated symbol-bearing reels 52. Alternatively or additionally, the basic-game screen 50 portrays a plurality of mechanical reels or other video or mechanical presentation consistent with the game format and theme. The basic-game screen 50 also advantageously displays one or more game-session credit meters 54 and various touch screen buttons 56 adapted to be actuated by a player. A player can operate or interact with the wagering game using these touch screen buttons or other input devices such as the buttons 20 shown in FIG. 1. The CPU operate(s) to execute a wagering game program causing the primary display area 12 or the secondary display area 14 to display the wagering game.

In response to receiving a wager, the reels 52 are rotated and stopped to place symbols on the reels in visual association with paylines such as paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering game outcome is provided or displayed in response to the wager being received or detected. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 12 or secondary display 14) through the display of information such as, but not limited to, text, graphics, static images, moving images, etc., or any combination thereof. In accord with the method of conducting the wagering game, the CPU transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the CPU (e.g., CPU 30) is configured to process the electronic data signal, to interpret the data signal (e.g., data signals corresponding to a wager input), and to cause further actions associated with the interpretation of the signal in accord with computer instructions relating to such further actions executed by the controller. As one example, the CPU causes the recording of a digital representation of the wager in one or more storage media (e.g., storage unit 44), the CPU, in accord with associated computer instructions, causing the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU (e.g., the wager in the present example). As another example, the CPU further, in accord with the execution of the instructions relating to the wagering game, causes the primary display 12, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by an RNG) that is used by the CPU to determine the outcome of the game sequence, using a game logic for determining the outcome based on the randomly generated number. In at least some aspects, the CPU is configured to determine an outcome of the game sequence at least partially in response to the random parameter.

Figure 4:
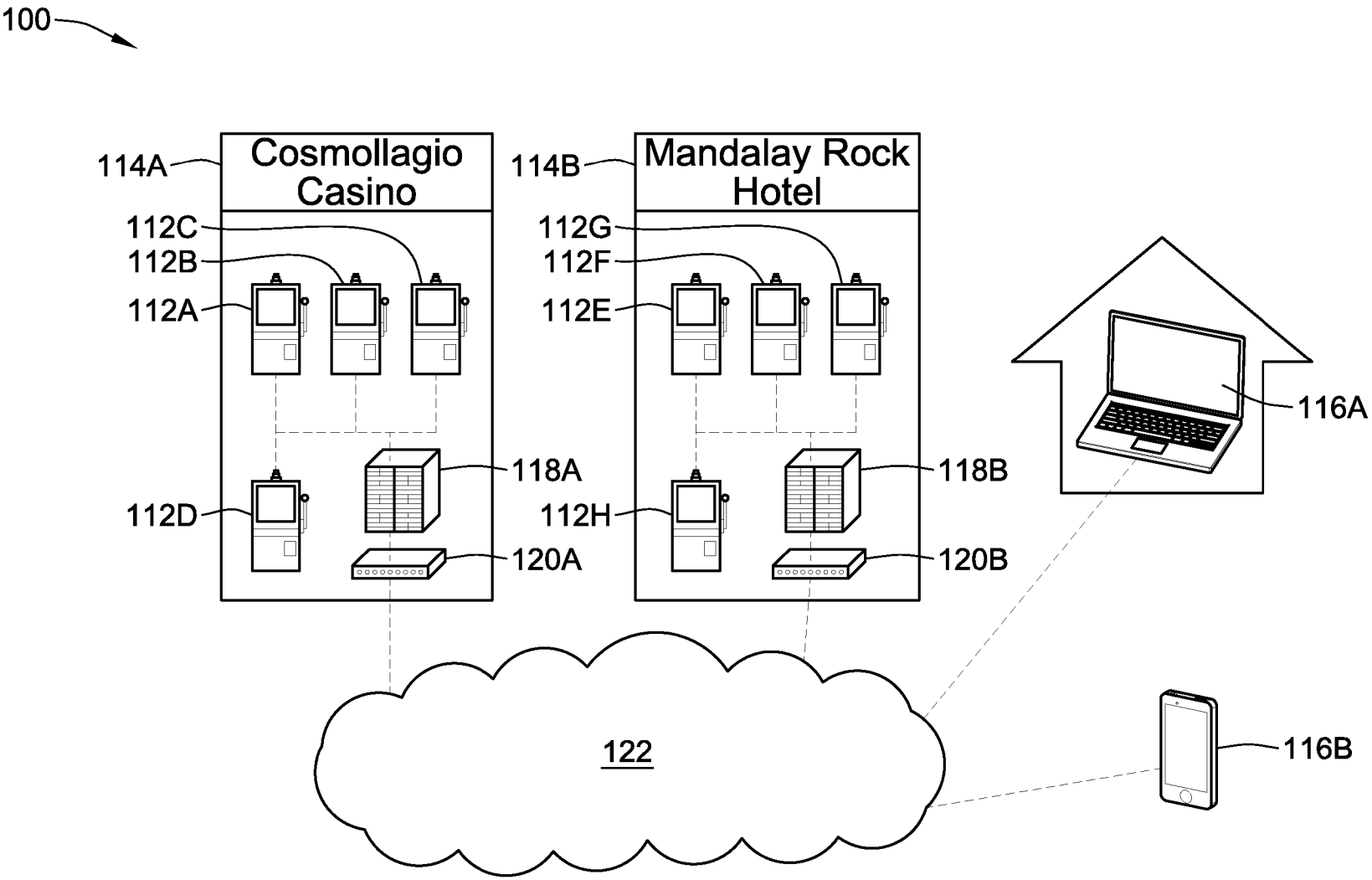
FIG. 4 is a diagrammatic illustration of a representative gaming system and network in accordance with aspects of the present disclosure.

FIG. 4 is a diagrammatic illustration of a representative gaming system and network, which are collectively designated 100, with which aspects of the disclosed concepts can be practiced. The gaming system and network 100 may be a web-based system for integrating casino gaming with non-casino interactive gaming, and vice versa. As shown, the gaming system and network 100 includes a first plurality of gaming terminals 112A-D located in a first "land-based" gaming establishment 114A (e.g., the "Cosmollagio Casino"), and a second plurality of gaming terminals 112E-H located in a second "land-based" gaming establishment 114B (e.g., the "Mandalay Rock Hotel"). Also included are a variety of personal computing devices, represented herein by a laptop computer 116A and a mobile phone with a built-in mobile computing platform (or "smartphone") 116B, which are remote from either of the gaming establishment 114A and 114B. Each of the gaming establishments 114A-B utilizes a local "casino" server 118A and 118B, respectively, which is communicatively coupled to a corresponding communications hub 120A, 120B. The local servers 118A-B individually, collectively and/or in collaboration with an offsite central server system (not shown), can offer a plurality of wagering games in such categories as slots, poker, bingo, keno, and blackjack, for example.

The land-based gaming establishments 114A-B, including one or more of the gaming terminals 112A-H, are shown linked to the personal computing devices 116A-B by a reconfigurable, multi-site computer network, such as an intranet 122. The personal computing devices 116A-B, which are remote from any land-based gaming establishment, may communicatively connect, with proper authorization, to one or more of the local servers 118A-B and/or gaming terminals 112A-H via the intranet 122. In so doing, one or more of the wagering games that are available on the local servers 118A-118B may be conducted via either the gaming terminals 112A-H and/or or the personal computing devices 116A-B. Although differing in appearance, the gaming terminals 112A-H can be similar in function and connectivity to the gaming terminal 10 discussed above with respect to FIGS. 1 and 2. The gaming terminals 112A-H of FIG. 4 can take on various configurations, including free standing gaming machines, handheld gaming machines, countertop gaming machines, personal computers or laptop computers, or any combination thereof.

The intranet 122 may be a network based on TCP/IP (Transmission Control Protocol/Internet Protocol) protocols belonging to an organization, usually a corporation, accessible only by the organization's members, employees, and/or others with proper authorization. In the illustrated system, the intranet can be used to securely network the gaming terminals 112A-H to a local casino server 118A-B and other terminals, both inside and outside of their respective establishments 114A-B. Each of the local servers 118A-B can operate an intranet web site and post wagering games on the web site. The web site can include a firewall to fend off unauthorized access. With proper authorization, the non-casino-based personal computing devices 116A-B may access the web page(s) via the internet 122 and thereby link to the local casino servers 118A-118B and even the gaming terminals 112A-H. As will be developed in further detail below, the internet 122 can also be used for the individual gaming terminals 112A-H to transmit gaming features to each other and to the personal computing devices 116A-B.

When a wagering game is conducted via one of the gaming terminal 112A-H, the wagering game may be conducted at a server level, a terminal level, or a hybrid server/terminal level depending, for example, upon how the machine and the system are set up. Likewise, when a wagering game is conducted via one of the personal computing device 116A-B, the wagering game may be conducted at a server level or a hybrid server/device level depending, for example, upon how the device and the system are set up. When the wagering game is conducted at the server level, the game's audiovisual content and game software are executed, for example, at one of the local casino servers 118A-118B. In this case, the gaming terminals 112A-H and/or personal computing devices 116A-B need not include a game engine for executing the game software and primarily serve as a display device. To allow the terminals 112A-H and/or computing devices 116A-B to execute the audiovisual content and game software, this information is downloaded from a local casino server 118A-B to the terminal 112A-H or device 116A-B and stored locally prior for conducting the wagering game. When the wagering game is conducted at the hybrid level, the audiovisual content is executed at the terminal 112A-H or device 116A-B while the game software is executed at the server 118A-118B. To allow the terminal 112A-H or device 116A-B to execute the audiovisual content, the audiovisual content is downloaded from the server 118A-118B and stored locally on the gaming device prior to conducting the wagering game. In order to make wagering games conducted via a computing device 116A-B verifiable, it may be required that the random event be generated at the server 118A-B. Thus, in some embodiments, wagering games may not be conducted solely at the device level.

The gaming terminals 112A-H can also be networked to each other and a server 118A-B by the intranet 122. The gaming terminals 112A-H in each land-based gaming establishment 114A-B can be linked by a high-speed local area network, such as a wireless or wired Ethernet. Each local area network can be configured to support standard Internet protocols, such as TCP/IP, for transmitting data over the local area network and transmitting data between the local area network and a local system 118A-B. The local casino server 118A-B may include a gateway that serves as an entrance to the local area network. The gateway can be associated with a router, which knows where to direct a given packet of data that arrives at the gateway, and a switch, which furnishes the actual path in and out of the gateway for a given packet. The communications hub 120A-B can consolidate data transferred to and from the gaming terminals 112A-H. A workstation (not shown) may be used to program, control, and monitor the gaming terminals 112A-H at the local casino level.

Figure 5:
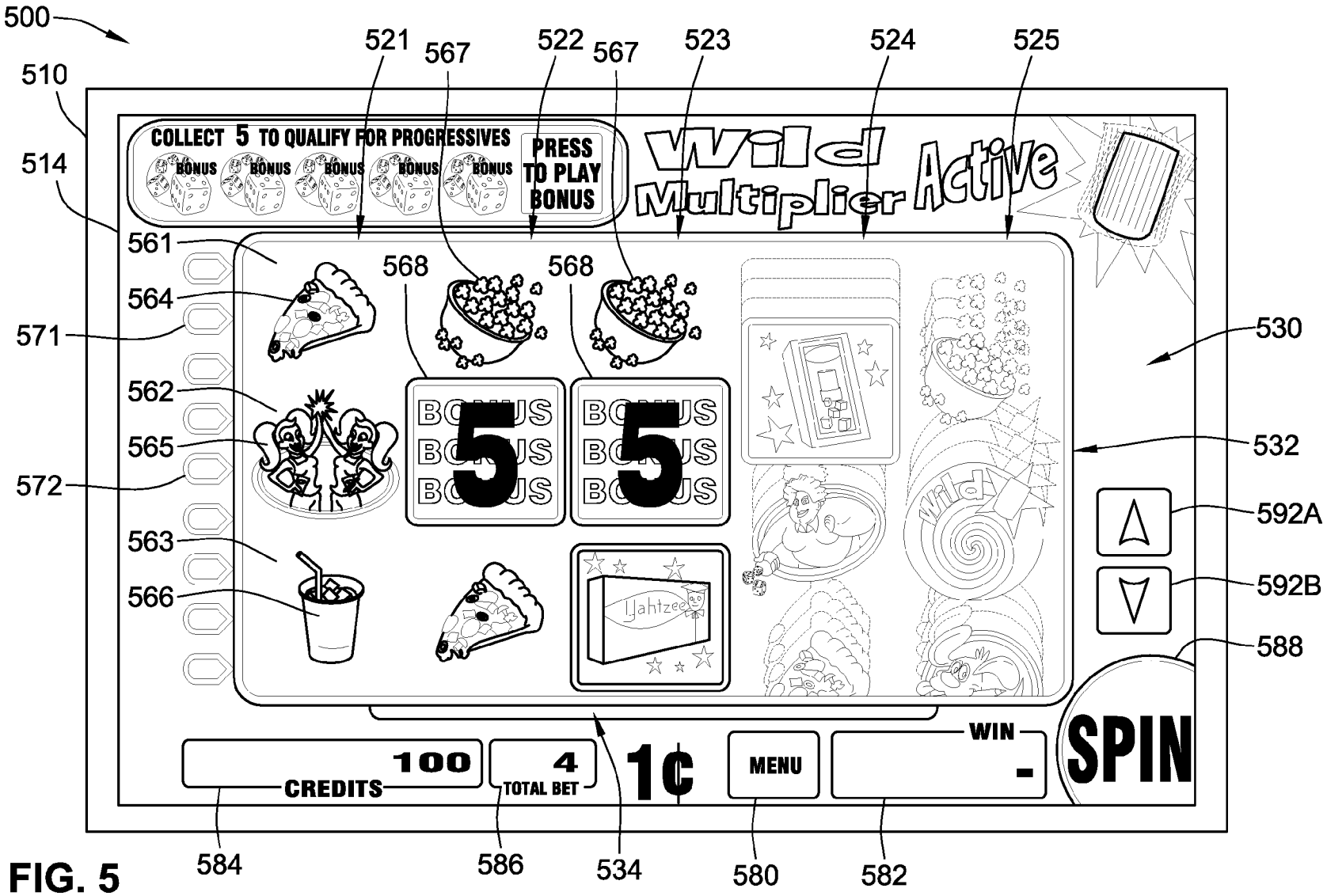
FIG. 5 is a screen shot of a display device displaying an exemplary wagering game with a finish-my-game feature in accordance with aspects of the present disclosure.

FIG. 5 is a screen shot of a game screen from an exemplary wagering game in accordance with aspects of the present disclosure. A primary display 514 of a gaming device or terminal 510, which may be part of an exemplary gaming system 500, is shown is FIG. 5. The gaming system 500 may be similarly configured to the gaming systems shown in FIGS. 2 and 4. The gaming terminal 510 of FIG. 5 can take on various alternative configurations, including, without limitation, upright freestanding gaming machines, slant-top freestanding gaming machines, handheld and portable gaming machines, countertop gaming machines, personal computers and laptop computers, or other known gaming devices, individually or in any combination thereof. The primary display device 514 of the gaming terminal 510 displays wagering games, such as those described above with respect to FIGS. 1-3 or those described below with respect to FIGS. 4-9, for example. The display device 514 may be any form of display, such as those described with reference to the free-standing gaming terminal 10 of FIG. 1. For instance, the primary display 514 may comprise a plasma, LED, OLED, LCD, CRT, projection, or any other now-known or later-developed display device. Although numerous aspects of the wagering game 530 are all shown displayed on a single display device (i.e., the primary display 514), these aspects are not so limited and can be displayed in any combination on any number of display devices unless otherwise expressly prohibited.

The display device 514 displays or otherwise visually depicts a wagering game 530, which in this example is the slot game shown in FIG. 5. The slot game 530 includes a plurality of symbol-bearing reels, designated generally as 521-525, respectively, each having a plurality of distinct symbol positions (collectively represented by the three symbol positions 561-563 in the symbol array 532) and bearing a number of symbols (collectively represented by five symbols 564-568 in the symbol array 532). The symbols may include any variety of graphical symbols, emblems, elements, or representations, including symbols that are associated with one or more themes of the gaming terminal 510 and gaming system 500 (e.g., Pizza Party). The symbols may also include a blank symbol or empty space. The symbols on the reels 521-525 are arranged in an array 532, which in this embodiment is a 3×5 matrix (i.e., three rows by five columns) of symbols. The reels 521-525 are varied (e.g., spun and stopped) to reveal combinations of symbols in the array 532, which represent randomly selected outcomes of the wagering game 530, that are evaluated for winning symbol combinations. Winning combinations of symbols landing, for example, on activated paylines (e.g., those paylines for which a wager has been received), cause awards to be paid in accordance with one or more pay tables associated with the gaming system 500.

Within the scope of this disclosure, the wagering game 530 can include greater or fewer than five symbol-bearing reels (simulated, mechanical, or otherwise) and, in some embodiments, greater or fewer symbol positions than those shown in FIG. 5. In this regard, the randomly selected outcomes may comprise greater or fewer than 15 symbols, and may take on a variety of different forms having greater or fewer rows and/or columns. The matrix may even comprise other non-rectangular forms or arrangements of symbols. Moreover, the randomly selected outcomes of the wagering game 530 may be varied from the representation provided in FIG. 5. Likewise, the Pizza Party game theme is purely illustrative and non-limiting in nature.

The primary display 514 further includes certain display features for providing information and options to a player. For example, the display 514 features may include a MENU button 580, a WIN meter 582, a CREDITS meter 584, and a TOTAL BET meter 586. The MENU button 480 can be pressed and activated (e.g., through an overlying touch screen) by a player desiring to access other control menus, preferences, help screens, informational menus, etc. For example, the player can change a theme of the wagering game 530 via the MENU button 580, or change the type of the wagering game (e.g., to video poker, keno, etc.). The WIN meter 582 displays to the player the amount of the total win (if any) from the most recent play of the wagering game 530. The CREDITS meter 584 displays to the player the total amount of credits (if any) remaining and available to the player for play of the wagering game 530. The TOTAL BET meter 586 displays to a player the current size of his/her wager (in credits). Once a number of paylines are selected and a wager is placed, a SPIN button 588 can be pressed or otherwise activated by a player to effectuate rotation of the reels 521-525. In an optional configuration, selection of a SPIN button will effectuate rotation of the reels 521-525 without requiring prior selection of a wager and/or a number of paylines (e.g., a default wager and a default number of payline(s) are automatically chosen upon selection of the SPIN button).

Fewer, additional, or alternative display features may be included for presenting information and/or options to a player. In one specific instance, a row of player-selectable LINES buttons can be provided to give players the option of quickly selecting and activating a predetermined number of paylines (e.g., 1, 5, 9, 20 or 40 lines). Another option would be to display a row of player-selectable PER LINE buttons, which gives a player the option of quickly selecting a predetermined bet per payline (e.g., 1, 2, 3, 5 and 10 credits per activated payline). The primary display 514 can also include, for example, an optional CHANGE DENOM button that can be activated to change the denomination of wagers (e.g., from 1¢ per credit to 25¢ per credit) which the player is inputting into the system 500. Other features may include, in some non-limiting examples, one or more bet change buttons 592A and 592B that permit a player to incrementally increase and/or decrease the size of his/her wager, a MAX BET SPIN button (not shown) for wagering a maximum number of credits and contemporaneously varying the reels of the wagering game 430, as well as any of the other buttons and meters presented herein or other features now known or hereinafter developed.

The wagering game 530 is shown in FIG. 5 after play of a base game or bonus game segment is initiated, for example, by the player providing a wager (e.g., responsive to an input via at least one input device) and thereafter pressing a spin button or pulling a spin lever. The monetary wager, which is typically a selected number of credits, is deducted from the available credits, e.g., the 100 credits displayed via the CREDITS meter 584 in FIG. 5. The monetary wager that is in play (e.g., 4 credits in FIG. 5) can be displayed via the TOTAL BET meter 586. The reels 521-525 may then be varied (e.g., spun and stopped); the reels 521-525 continue to spin until they are stopped to reveal in the symbol array 532 symbols which represent a randomly selected outcome of the wagering game 530. The wagering-game outcome is, according to some aspects, randomly determined from a plurality of potential wagering-game outcomes. As indicated above, each outcome is evaluated for winning symbol combinations—to determine if the displayed outcome has one or more awards associated therewith.

A local controller (e.g., CPU 30 of FIG. 2), a host system (e.g., external system 48 of FIG. 2), a central controller, or any combination thereof, in alternative embodiments, operates to execute the wagering game program causing the display area 514 to display selected portions of the wagering game 530. An outcome of the wagering game can be randomly selected from a plurality of potential wagering-game outcomes (e.g., using a local random number generator (RNG)). The wagering-game outcome is then revealed, displayed, or otherwise communicated to the player, for example, on a corresponding display device 514. The game screen 514 displays the wagering-game outcome by portraying the plurality of simulated reels 521-525 spinning and stopping to reveal a plurality of symbols arranged in a 3-row, 5-column matrix—i.e., symbol array 532. A winning combination occurs, for example, when the displayed symbols correspond to one or more of the winning symbol combinations listed in a pay table. In response, a wagering-game prize (e.g., a monetary award) associated with a winning outcome is conferred upon the player.

Embodiments of the present disclosure include a FINISH MY GAME feature which offers multi-player collaboration to achieve a winning game result. Social gaming is dramatically expanding the gaming industry's consumer base. In the wagering game industry, social gaming typically refers to gaming environments which allow multiple players to play wagering games as a way of social interaction, as opposed to individual players playing a game in isolation. Many social network games are played over the Internet and are available as turn-based models that are seamlessly integrated into widely popular social networking websites, such as Facebook® and Twitter®. Social network games are most often implemented as "browser games," played on a personal computer over the Internet with a web browser employing standard web technologies or browser plugins. Social network games can also be implemented on other platforms, such as mobile devices, personal digital assistants (PDA), and mobile tablet devices. Even though social network games are often played via a web browser, they are distinct from traditional "browser games," for example, by leveraging a player's social graph and individual user data that is hosted on a particular social network website.

Some embodiments of the present disclosure leverage online social gaming environments to execute slot-based or other wagering-game content which incorporates a FINISH MY GAME feature. This provides a player with the ability to use their social network to complete a game outcome. Through the social network, the player can garner additional chances to achieve a winning game outcome by allowing the player to share a partial outcome with other players by distributing it through their social network to have that partial outcome completed by one or more network "friends." And any favorable outcomes, when completed by these friends, are returned to the original player. In a non-limiting example, whenever a player achieves two (2) bonus-triggering symbols on a subset of symbol-bearing reels in a slot game where three (3) bonus-triggering symbols are required to trigger the bonus game, the game automatically transitions into an anticipation-spin mode—where the remaining reels continue to spin—so the player cannot see the final outcome of the wagering game. A pop-up window or other prompt would then allow the player to transmit the partial outcome (i.e., the stopped and spinning reels) to friends through an online social network. When the partial outcome arrives at the friend(s), their game outcome would include the partial outcome and they would complete the spinning reels using a separate RNG-generated outcome. In so doing, each friend's outcome, as well as the player's original outcome, may be completely different; however, the original player benefits from any winning outcomes, either independently or communally.

Referring again to the example illustrated in FIG. 5, after a game initiating "first" wager is received from an originating "first" player to play the wagering game 530, a first outcome of the wagering game 530 is randomly determined (e.g., selected via an RNG) from a plurality of possible game outcomes. Optional configurations will initially only randomly determine a predetermined portion of the final wagering game outcome—i.e., a partial outcome. As indicated above, the first wagering game outcome is visually represented by a "first" plurality of symbols (15 in the illustrated example) arranged on the primary display device 514 in the array 532. The primary display 514 of FIG. 5 initially only reveals to the player a portion of the first outcome of the wagering game 530, referred to hereinafter as partial outcome 534. In the embodiment of FIG. 5, the three left-most reels 521-523 are stopped such that nine symbols are revealed to the player, while the two right-most reels 524, 525 continue to spin such that the last six symbols are initially unknown to the player. The displayed portion of the first outcome therefore includes some, but not all of the symbols displayed in the array 532.

Figure 6:
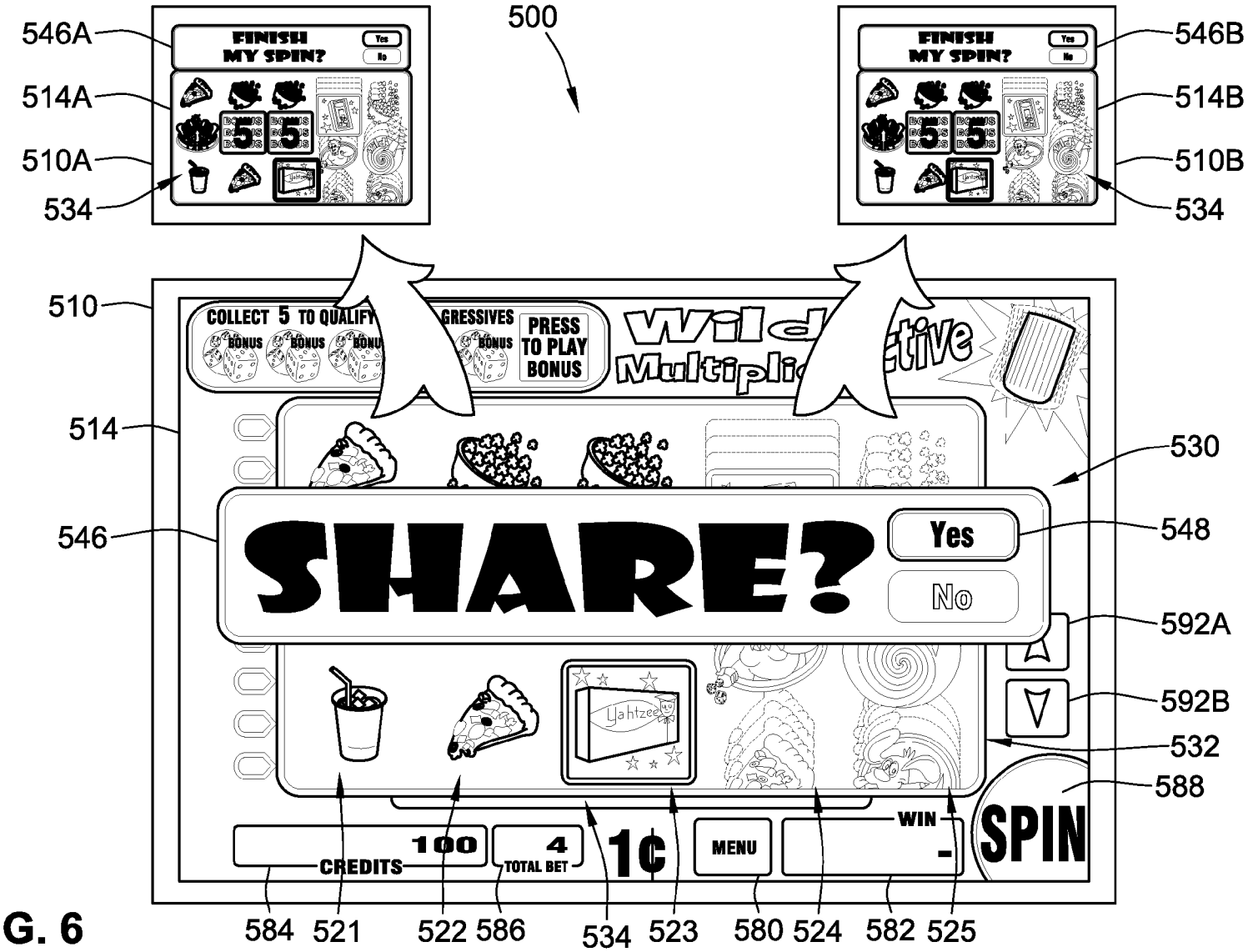
FIG. 6 is a diagrammatic illustration of the exemplary display device and wagering game of FIG. 5 showing a partial outcome of the wagering game being distributed to a plurality of other players with an option for those players to complete the partial outcome.

Once the partial outcome 534 is displayed on the primary display device 514, the randomly determined partial outcome 534 can be transmitted to and shared with one or more additional players. FIG. 6, for example, diagrammatically illustrates the partial outcome 534 of the wagering game 530 being disseminated to two other players with an option for each of those players to complete the partial outcome 534, as seen, for example, in the FINISH MY SPIN? popup windows 546A and 546B. In particular, FIG. 6 shows the display screens 514A and 514B of two separate gaming devices 510A and 510B, respectively. The gaming devices 510A-B may be take on the form of any of the devices disclosed herein or otherwise known that are operatively configured for playing a wagering game. By way of non-limiting example, the first gaming device 510A of a first additional player may be a free standing, upright gaming terminal located in the same gaming establishment and on the same gaming system 500 as the gaming terminal 510. In contrast, the second gaming device 510B of a second additional player may be a personal computing device that is remote from any land-based gaming establishment and operatively connected to the gaming terminal 510, for example, via the internet 122 of FIG. 4.

The option to transmit a partial outcome may, in some embodiments, be provided in response to a triggering event in the first outcome of the wagering game 530. The triggering event may be in the nature of a symbol-based trigger, a time-based trigger, a wager-based trigger, a collection-based trigger, a mystery trigger, etc., in or during the basic wagering game. An example of a symbol-based trigger includes at least two "Share My Spins" symbols appearing on an active payline in the partial outcome. In some embodiments, a player may be required to meet certain eligibility requirements to qualify for the option to transmit a partial outcome. The eligibility may be based on a number of factors, including acquisition of certain game assets (e.g., a key), reaching certain game milestones (e.g., completing a bonus game), exceeding a certain level of wagering activity, being a member of a certain gaming establishment group (e.g., casino player's club), and the like. Alternative arrangements can be designed to automatically share the partial outcome with other players without an input from the player. In a similar regard, the option to transmit a partial outcome may be presented to and selected by a player prior to initiation of play of the wagering game.

With the partial outcome 534 displayed, the player may be asked, e.g., via a popup window 546, whether to SHARE? the partial outcome 534. As seen in FIG. 6, the player has selected the YES button 548 (e.g., via an overlaying touch screen) to distribute and share the partial outcome 534. Optional variations may forego a visual or audible prompt; such configurations can allow or require the player to make a selection prior to each, every, or only selected plays of the wagering game 530. In yet another alternative variation, the determination to transmit the partial outcome 534 may be automated. Sharing the partial outcome 534 may optionally include providing information regarding the potential awards associated with completing the partial outcome.

Some embodiments may require the player to submit additional credits (a "side wager"), on top of the original wager received to initiate the wagering game, to share the partial outcome 534. The amount of additional credits may depend, for example, on the number of secondary players to whom the partial outcome 534 is being sent, the potential value of winning outcome(s) that may result from the symbols already revealed by the partial outcome 534, etc. Some configurations will allow players to use virtual currency (e.g., Facebook® credits) to pay for the transmittal. Alternatively, players can choose to purchase a SUSPEND MODE with an added upfront fee. By choosing this option before play of the wagering game 530 commences, the player can choose whether or not (and, in some embodiments, when) to halt the sequential stopping of the spinning reels 521-525, to suspend and save the partial outcome, then via community or social feed, post, sell, auction, and/or gift the option to finish the game, for example, another time of day or to transfer the game in progress to another player. As opposed to submitting an additional wager to transmit and/or participate in the partial outcome, characteristics of the wagering game or partial outcome can be modified to offset the additional winning opportunities garnered by transmitting the partial outcome to additional players. This concept will be developed in further detail below.

Continuing with the example shown in FIG. 6, the option to transmit the partial outcome 534 to a second player is provided at least partially in response to the partial outcome 534 including a portion of at least one predetermined winning outcome, but not including any complete winning outcomes. In the illustrated embodiment, which is more clearly seen in FIG. 5, the randomly determined partial outcome 534 of the wagering game 530 includes portions of two different predetermined winning symbol combinations: two popcorn symbols 567 are aligned along an active payline 571 in the first row of the array 532 on the second and third reels 522, 523; and, two 5-bonus-spin bonus-game triggering symbols 568 are aligned along an active payline 572 in the second row of the array 532 on the second and third reels 522, 523. Nevertheless, there are no complete winning line-pay combinations, scatter-pay combinations or bonus-triggering combinations included in the partial outcome 534 of FIG. 5.

Transmitting the partial outcome 534 to one or more additional players may include posting the partial wagering game outcome on a social networking website, such as a Facebook® page or a Twitter® feed, that is external to the gaming system 500. For example, the player may use money (e.g., game credits) or virtual currency (e.g., Facebook® credits) to pay to suspend a game and post a partial outcome, e.g., on their Facebook® wall or through a centralized Twitter® account, and thereby advertise its availability. In this regard, the additional players to whom the partial outcome can be transmitted may be restricted to those who are members with the originating player of a designated group within a particular social networking website. For example, the player may be restricted to people with whom she/he is designated as a "friend" through Facebook® or Myspace®, part of a common "circle" on Google+®, a "follower" of or "followed" by on Twitter®, a "contact" or "group" member on Linkedin®, etc. Optionally, each additional player who wishes to be eligible to receive a partial outcome may be required to sign up and/or pay to be an eligible recipient, e.g., at a casino webpage. Moreover, when a player initiates play of the wagering game 530, the gaming system 500 could be configured to automatically access one or more of the player's social networking accounts (and optionally provide access to the account from the gaming terminal 510), and/or automatically sync future game play to those accounts (e.g., start randomly picking "friends" and/or "contacts" that are added to a distribution list). In some configurations, the player designates a distribution list, whereas other configurations employ a randomly generated distribution list.

The gaming manufacturers and proprietors may be allowed to contain or otherwise regulate how many people and which people can receive any or all partial outcomes. Optionally, the FINISH MY GAME feature can be limited by predetermined geographic restrictions. For example, distribution of the partial outcome may be limited to friends at the same bank of gaming terminals, friends within the same gaming establishment, friends within X-number of miles of the player, or friends within a particular city or state. Such geographic restrictions may depend, for example, on the content and potential payout of the partial outcome. One non-limiting example includes limiting distribution of a partial outcome poker hand with four-to-a-royal to players within that gaming establishment, whereas a partial outcome poker hand with three-to-a-straight may be distributed to people anywhere in that state. In a similar regard, the distribution list may be limited to a particular environment (e.g., Facebook®) and/or a group within that environment (e.g., limited to family members and/or immediate friends on Facebook®). In this regard, a secondary player who wishes to be considered for the FINISH MY GAME feature may use a GPS-based location detection feature or a social network feature to establish eligibility, for example, by using Foursquare® or Facebook® to "check in" to a particular casino. When a partial outcome is generated and selected for distribution, the gaming system 500 can determine which people are eligible to participate in the feature based upon recent check-in's. By way of contrast, the player could be allowed to generate a mass transmission (e.g., a "bulk email") to any number of players at any number of locations via any number of social networking accounts to maximize the virality of game feature.

There may be other criteria that determines the limitations for who and how many people are eligible to participate in a particular partial outcome. The FINISH MY GAME feature, for example, may have time-based restrictions (e.g., each additional player must elect and complete the partial outcome within X-hours or Y-days), location-based restrictions (e.g., each additional player must be within a particular gaming establishment at the time the partial outcome is posted), size limitations (e.g., only the first ten people to respond can take advantage of the feature), etc. Additional eligibility constraints may require the formation of a group of players that combine to increase funds in the group's "pool" of money. For instance, each additional player may be required to be a part of a "syndicate" and pay to be a part of that syndicate. While a part of the syndicate, any player who wins a jackpot in a syndicate shares the winnings with the other members. It is generally not necessary for the additional players (e.g., the network friends) to be playing at the same time as the originating player or each other. In some embodiments, whenever an additional player logs onto their social networking account or a personal email account, they will be notified that the originating player sent a request to finish their partial outcome of the wagering game.

Other options may include a dynamic system to determine how many people can be offered the FINISH MY GAME feature and/or how much each additional player will be required to pay/wager to finish a distributed partial outcome based, for example, on the probabilities of a winning outcome resulting from the partial outcome. For instance, when the partial outcome is posted on the player's Facebook® page or Twitter® feed, e.g., after the player submits an additional "side" wager, the gaming system 500 may dynamically determine the number of people who can pay to take advantage of the FINISH MY GAME feature and/or a different amount each person has to pay to take advantage of the feature. One example may require at least five (5) additional players elect to take advantage of the FINISH MY GAME feature, and each person must wager at least 30 credits.

As indicated above, some configurations will allow players (both the originating player and the additional player(s)) to use virtual currency (e.g., Facebook® credits) to pay for the FINISH MY GAME feature. In a purely social gaming environment, for example, in which players are playing solely for virtual "fun" money or other alternate currency, the underlying mathematical probabilities of the game (e.g., expected value and volatility) need not be varied to accommodate the FINISH MY GAME feature. In essence, the wagering game 530 does not need to balance out the transmittal of a potentially high-paying partial outcome (e.g., four-to-a-royal hands) to a large group of secondary players (e.g., 50 friends) because the wagers and payouts are based in virtual currency.

The one or more additional players to whom the partial outcome is transmitted could be determined by displayed indicia in the partial outcome of the wagering game 530. By way of example, and not limitation, the partial outcome of FIG. 5 has two bonus-triggering symbols 568 aligned along an active payline 572. The bonus-triggering symbols 568 could each be modified to include indicia of the identity of a secondary player. Such indicia may include incorporating one or more bonus-triggering symbols 568 each with a Facebook® profile picture of one of the player's Facebook® friends. When the two bonus-triggering symbols 568 land on an active payline 572, triggering the FINISH MY GAME feature, the feature is automatically sent to the Facebook® friends depicted in the bonus-triggering symbols 568. Automated variations could include the gaming system 500 pulling and randomly selecting people from a catalogue of potential players (e.g., a player's Facebook® friend list).

Other variances may require the player to tag players for inclusion in the FINISH MY GAME feature, or select a particular group of contacts or a photo album from which the additional players are chosen by the system 500. Alternatively, the indicia could include other player information, such as an additional player's Twitter® ID (or "handle"), or the location of a group of potential players, such as the name or emblem of particular social networking website, a specific city, or a particular gaming establishment. In addition (or as an alternative) to utilizing reel symbols with indicia of potential secondary players, indicia could be incorporated into other aspects of the wagering game, such as active paylines, the cards of a poker or blackjack hand, the spots on a betting field in roulette or craps, ball numbers in a keno or bingo game, etc. Additional aspects may include mapping the FINISH MY GAME feature to people having similar likes as the originating player.

Figure 7:
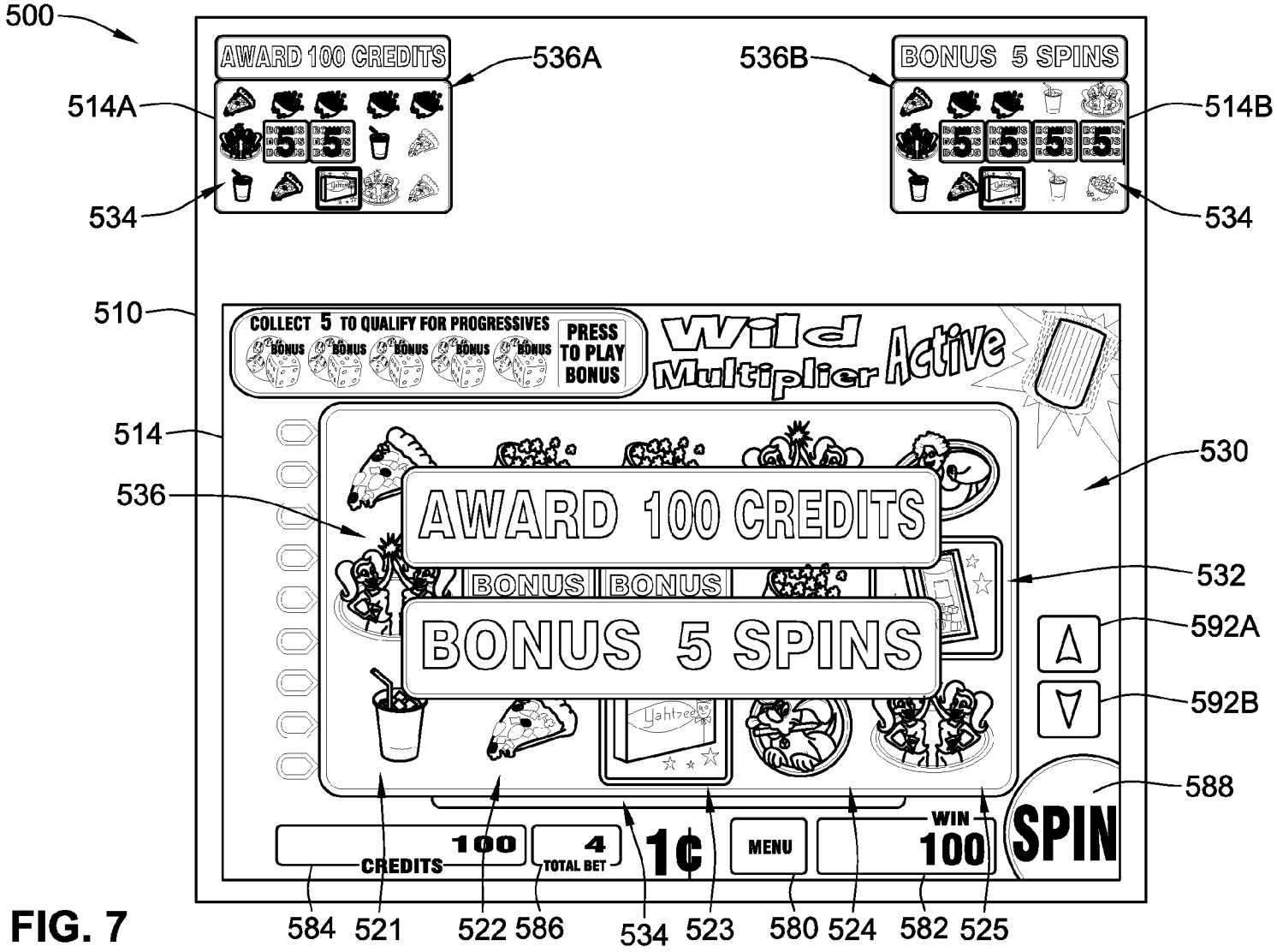
FIG. 7 is a screen shot of a display device displaying the exemplary wagering game of FIG. 5 showing the final wagering game outcome and the distributed partial outcomes after being completed by the other players.

Once the partial outcome is transmitted to one or more additional players, as illustrated in FIG. 6, a "first" final outcome of the wagering game 530 is displayed to the first player, as seen in FIG. 7. The first final outcome of the wagering game 530 may be determined prior to, during or after the transmission of the partial outcome. As indicated above, optional configurations will initially only randomly determine a predetermined portion of the final wagering game outcome (i.e., the partial outcome) prior to transmitting the partial outcome, and subsequently randomly determine the remaining segments of the outcome. In some embodiments, after the wagering game 530 is initiated (e.g., by pressing the SPIN button 588), a determination of the whole/partial outcome of the wagering game 530 is made, and the wagering game 530 is suspended (e.g., after the first three reels 521-523 are stopped), the gaming system 500 can reevaluate and reassign the mathematical probability of a winning final outcome based, for example, on how many people the partial outcome is transmitted to, the potential payout of the partial outcome, the initial and/or additional wagers, etc. Two factors that may be modified to offset the number of additional players are the probability and the payout for an outcome. For instance, each new friend added by a player to the distribution list results in an incremental decrease in the probability of a payout and/or a potential payout value. In some embodiments, the probability and potential payout can be varied from player to player. In other optional configurations, the wagering game 530 could draw on coin-in (i.e., a percentage of money wagered) from a progressive jackpot to offset the number of additional players.

In any variation, the final outcomes of the originating and additional players, each of which stems from the partial outcome, are not displayed to the first player until after distribution of the partial outcome. The primary display device 514 is shown in FIG. 7 revealing the first final outcome 536 to the first player. As can be seen in FIG. 7, the first final outcome 536 includes the same symbols in the same symbol positions as those in the shared partial outcome 534—i.e., the same nine symbols in the first three columns of the symbol array 532. In this particular final outcome 536, the first player has not received any winning line-pay symbol combinations or bonus-game-triggering symbol combinations.

In FIG. 7, the various final outcomes of the additional players are also revealed to the player. According to this specific example, the primary display device 514 reveals two additional final outcomes: a second final outcome 536A of the first additional player comprising a second plurality of symbols, and a third final outcome 536B of the second additional player comprising a third plurality of symbols. It should be readily apparent that greater or fewer than two additional final outcomes could be generated for the first player, each of which may comprise different symbols from those shown in FIG. 7. Both the second and third final outcomes 536A, 536B are randomly determined separately from the first final outcome 536; nevertheless, both of the final outcomes 536A, 536B include the partial outcome 534—i.e., the same nine symbols in the first three columns of the symbol array 532. Determining the additional final outcomes 536A, 536B can be at least partially in response to the additional players electing to complete the partial outcome 534 (e.g., via popup windows 546A and 546B of FIG. 6) and/or the submission of an additional wager from each of the additional players after the sharing of the partial outcome 534. Moreover, it may be desirable that the gaming system 500 and/or gaming terminal 510 conduct each of the random determinations; nevertheless, each additional player may receive, initiate, conduct and/or view the gaming feature remotely (e.g., on their own personal computing device while visiting a social networking site).

If at least one of the final outcomes is a winning outcome—e.g., includes a winning symbol combination or a bonus-triggering symbol combination along an active payline, an award associated with the winning outcome is conferred upon one or more of the players. It is preferred, in at least some embodiments, that the first, originating player benefits from any winning outcome in any of the final outcomes 536, 536A, and 536B. In so doing, the first player is incentivized to distribute the partial outcome to as many people as possible (i.e., increase verality) in the hopes of benefiting from any winning outcomes achieved by friends who elects to participate in the FINISH MY GAME feature. Some aspects of the disclosed concepts include awarding the award to both the first player and the corresponding additional player who achieved the winning outcome. That is, each of the additional players receives any award resulting from their own final outcome; the first player receives that award as well. Optionally, all of the players who elect to participate in the FINISH MY GAME feature can receive a corresponding award or, at a minimum, at least a share of the award. For example, the total payout for all of the final outcomes can be pooled and then divided amongst all members of the distribution group (i.e., each player receives a fractional portion of the total pool). Alternatively, only the additional player will benefit from their final outcome, while the first player does not receive anything in return for transmitting the partial outcome. Similar variances can include methods of gifting a partial outcome, which are readily amendable to social gaming applications. Optionally, the first player, alone or with one or more of the additional players, can receive a non-monetary benefit. Such benefits may include free concert tickets, free meals, a free room at the casino/hotel, or any number of prizes that that particular establishment wishes to offer.

In the example illustrated in FIG. 7, the second final outcome 536A of the first additional player includes a winning line-pay outcome—e.g., four popcorn symbols 567 are aligned along an active payline. A 100 credit value is associated with the winning line-pay in the second final outcome 536A; as such, both the first player and the first additional player are awarded 100 credits. Moreover, the third final outcome 536B of the second additional player includes a start-bonus winning outcome—e.g., four bonus-game triggering symbols 568 are aligned along an active payline. A bonus game with five free bonus-spins is associated with the start-bonus winning outcome in the third final outcome 536B; as such, both the first player and the second additional player are awarded a bonus game. In some embodiments, the bonus game awarded to the first player is conducted independently from the bonus game awarded to the second additional player.

Figure 8:
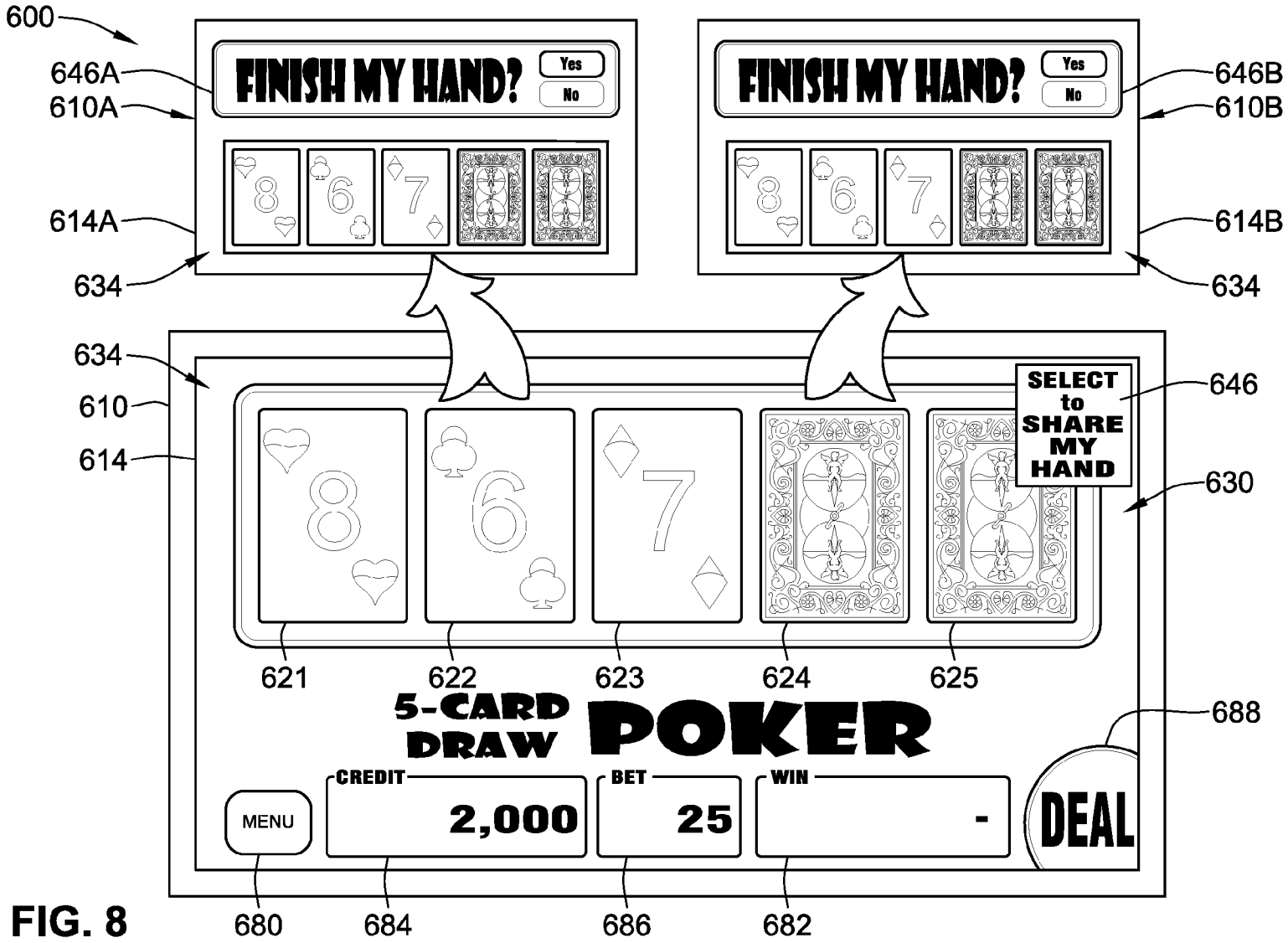
FIG. 8 is a diagrammatic illustration with a screen shot of a display device displaying another exemplary wagering game with a finish-my-game feature in accordance with aspects of the present disclosure.

The various features and aspects of the present disclosure are not per se limited to slot games; these features and aspects can be applied to any partial outcome of a wagering game that can be interrupted, suspended and distributed before the final outcome is displayed. Some non-limiting examples include applying the FINISH MY GAME feature to bonus games, progressive games, well-known communal games, such as Bingo, skill based games, such as electronic bowling, and sports games, such as fantasy sports, sports wagering, etc. As a representative example, FIG. 8 is a screen shot of a game screen from another exemplary wagering game shown in accordance with aspects of the present disclosure. A primary display 614 of a gaming device or terminal 610, which may be part of an exemplary gaming system 600, is shown in FIG. 8. The gaming system 600 and gaming terminal 610 of FIG. 8 can take on any of the various forms, optional configurations, and functional alternatives described with respect to the other embodiments presented herein, and thus can include any of the corresponding options and features. For instance, the primary display 614 of the gaming terminal 610 displays wagering games, which can include any of the options and variations described above regarding the FINISH MY GAME feature.

The gaming terminal 610 may be a freestanding gaming device (networked or standalone) as seen, for example, in FIG. 1, a handheld gaming device (not shown), one of the personal computing devices 116A-B shown in FIG. 4, or any other similarly configured device having a display. The display 614 may be any form of display, such as those described with reference to the free standing terminal of FIG. 1. In this embodiment, the wagering game is presented as a video poker game 630, which is exemplified as standard "Five Card Draw" poker. It should be recognized, however, that the wagering game presented in FIG. 8 may comprise other forms of poker, such as "Texas Hold'em," "Omaha Hi," "Seven Card Stud," etc., as well as other card games, such as black jack, gin, mah-jongg, baccarat, and known variations thereof, without departing from the scope and spirit of the present disclosure.

It may be desirable that the poker game 530 be played with a single, standard 52-card deck (i.e., Ace through King of four different suits). One or more cards (e.g., sevens, "one-eyed jacks", "suicide kings", etc.) may be designated as "wild". One or more "Joker" cards may be added to the standard deck, each of which may be designated with a predetermined characteristic (e.g., wild). Further, the poker game may be played with additional predefined "special" card(s) (e.g., a "Go Fish!" card) for triggering a special feature (e.g., a "Go Fish!" feature). Such a special feature is disclosed in U.S. Pat. No. 7,056,206 B2, to Dion K. Aoki et al., which issued on Jun. 6, 2006, and is entitled "Method of Conducting a Video Poker Game," which is incorporated herein by reference in its entirety.

During a particular game play or "hand," all dealt and drawn cards preferably come from the same deck (but may, alternatively, come from multiple decks). As such, after a card is dealt or drawn from the deck into the poker hand, that card is "used up" and cannot appear again until at least the next poker hand. The deck may thereafter be replenished and randomly shuffled prior to every poker hand or, alternatively, after cycling through the entire deck or stack of decks. The system memory 44 preferably includes a data structure for storing data representing each card of the deck. The CPU 42 selects cards for each poker hand from the data structure, and controls at least one of the displays 14, 16 to display the cards.

In the screen shot of FIG. 8, the poker game 630 includes five playing cards 621-625, certain game-session meters, various buttons selectable by a player, and may include a pay table (not shown). In the illustrated embodiment, the game-session meters include, for example: a MENU button 680 that can be activated by a player desiring to access other control menus, preferences, help screens, etc.; a WIN meter 682 for displaying a total number of credits awarded (if any) as a result of the most recent play of the wagering game 630; a CREDITS meter 684 for displaying a total number of credits (if any) remaining and available for play; and a TOTAL BET meter 686 for displaying to a player the current size of his/her wager. Other fields and meters may be incorporated into the display 614, such as those disclosed in the discussion of FIGS. 3 and 5. Fewer, additional or alternative display features may be included for presenting information and options to a player of the wagering game 630.

The player-selectable buttons may also include a DEAL button 688 for causing the display of a "first" outcome the wagering game 630, or at least a portion thereof—e.g., deal an initial array of cards from a deck into a hand. The DEAL button 688 is also for causing the wagering game 630 to selectively modify the first outcome—e.g., draw cards from a deck to replace any cards in the hand not "held" by a player. A BET ONE button (not shown) may be included whereby the player increases the amount of the wager displayed in the BET meter 686 one credit for each press of the button. An EASY PLAY tab (not shown) may also be provided such that when a wining hand is dealt, a player may hold all the winning cards in the dealt hand, prior to the draw, with a single press of the EASY PLAY tab 694. The player-selectable buttons may comprise additional buttons, fewer buttons, and different buttons from those shown. For example, the player-selectable buttons may include a "speed" button for changing the speed at which cards are dealt from the deck (e.g., slow, medium, or fast).

After a game initiating "first" wager is received from an originating "first" player to play the wagering game 630, a first outcome of the wagering game 630 is randomly determined (e.g., selected via an RNG) from a plurality of possible game outcomes. As indicated above, other configurations will initially only randomly determine a partial outcome of the final wagering game outcome. The first wagering game outcome is visually represented by a "first" plurality of symbols (five playing cards in the illustrated example) arranged in a "hand" on the primary display device 614. The primary display 614 of FIG. 8 initially only reveals to the player a portion of the first outcome of the wagering game 630, i.e., partial outcome 634. In the embodiment of FIG. 6, for example, the first three playing cards 621-623 are revealed to the player, while the last two playing cards 624 and 625 are shown laying face down such that the last two cards are initially unknown to the player.

Once the partial outcome 634 is displayed on the primary display device 614, the randomly determined partial outcome 634 can be transmitted to and shared with one or more additional players for cooperative completion of the game outcome. FIG. 8 diagrammatically illustrates the partial outcome 634 of the wagering game 530 being disseminated to two other players with an option for each of those players to complete the partial outcome 634, as seen, for example, in the FINISH MY HAND? popup windows 646A and 646B. In particular, FIG. 8 shows the display screens 614A and 614B of two separate gaming devices 610A and 610B, respectively. By way of example, and not limitation, the first gaming device 610A of the first additional player may be a free standing gaming terminal located inside a land-based gaming establishment (e.g., gaming establishment 114A of FIG. 4). In contrast, the second gaming device 610B of the second additional player may be a personal computing device that is remote from any land-based gaming establishment (e.g., laptop computer 116A of FIG. 4).

With the partial outcome 634 displayed, the player may be asked, e.g., via a popup window 646, whether to SHARE MY HAND. As seen in FIG. 8, the player has chosen to distribute and share the partial outcome 634. Optional variations may forego a visual or audible prompt; such configurations can allow or require the player to make a selection prior to each, every, or only selected plays of the wagering game 630. In yet another alternative variation, the determination to transmit the partial outcome 634 may be automated. Some embodiments may require the player to submit additional credits (a "side wager"), on top of the original wager received to initiate the wagering game, to share the partial outcome 634. The amount of additional credits may depend, for example, on such facts as the number of secondary players to whom the partial outcome 634 is being sent, the potential value of winning outcome(s) that may result from the symbols already revealed by the partial outcome 634, etc.

Similar to the example shown in FIG. 6, the option in FIG. 8 to transmit the partial outcome 634 to a second player is provided at least partially in response to the partial outcome 634 including a portion of at least one predetermined winning outcome, but not including any complete winning outcomes. In the illustrated embodiment, the randomly determined partial outcome 634 of the wagering game 630 includes an 8-of-hearts on the first card 621, a 6-of-clubs on the second card 622, and a seven-of-diamonds on the third card 623. The partial outcome 634 offers a number of potential winning outcomes, including a possible 4-5-6-7-8, 5-6-7-8-9, or 6-7-8-9-10 straight, as well as various two-of-a-kind and three-of-a-kind card combinations. Nevertheless, there are no complete winning card combinations included in the partial outcome 634 of FIG. 8.

Once the partial outcome is transmitted to the additional player(s), the "first" final outcome of the wagering game 630 will be revealed to the first player. However, none of the final outcomes of the originating or additional players, each of which stems from the partial outcome 634, are displayed to the first player until after distribution of the partial outcome 634. Prior to, during, or after being displayed, the final outcome of the wagering game is evaluated for any winning symbol/card combinations. In a similar regard, the final outcome for each additional player who elects to participate in the FINISH MY GAME feature will also be revealed to the first player. Similar to the embodiment illustrated in FIG. 6, each final outcome for each additional player is randomly determined separately from the first final outcome, even though all of the final outcomes will include the partial outcome 634. If any of the final outcomes includes a winning card combination, an award associated with the winning outcome is conferred upon one or more of the players. It may be desirable that the first, originating player benefit from any winning outcome in any of the final outcomes. Nevertheless, any of the alternative payout options discussed above with respect to FIG. 7 can be similarly applied in the embodiment of FIG. 8.

Figure 9:
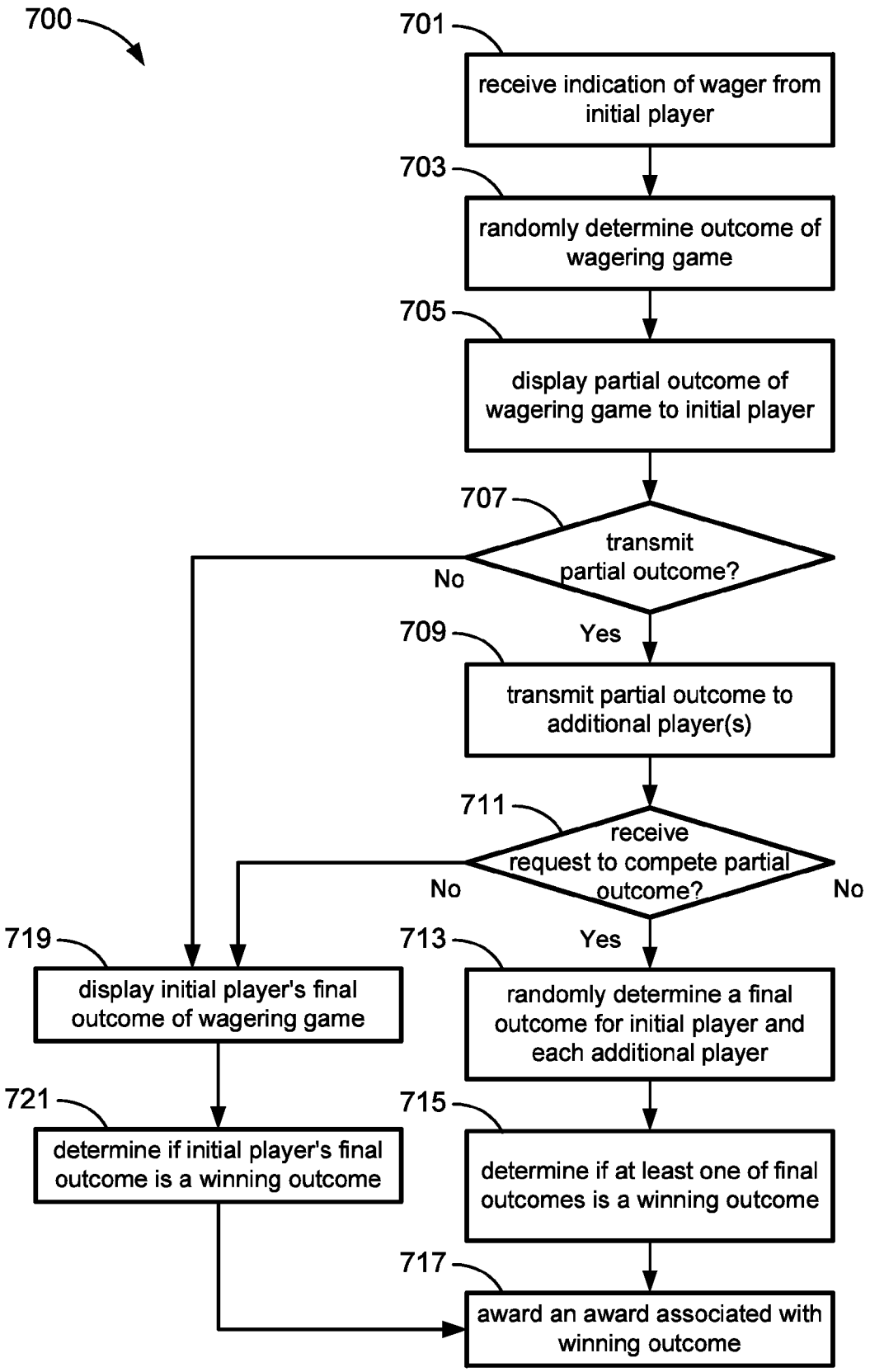
FIG. 9 is a flowchart for an exemplary method or algorithm that can correspond to instructions that can be stored on one or more non-transitory computer-readable media and can be executed by one or more controllers in accord with aspects of the disclosed concepts.

With reference now to the flow chart of FIG. 9, an improved method for conducting a wagering game on a gaming terminal and/or a gaming system, such as those shown in FIGS. 1-5, for example, is generally described at 700 in accordance with aspects of the present disclosure. FIG. 9 can be representative of an algorithm that corresponds to at least some instructions that can be stored, for example, in main memory 32 of FIG. 2, and executed, for example, by the CPU 30 and/or external system(s) 48 of FIG. 2 to perform any or all of the above or below described functions associated with the disclosed concepts. The method 700 will be described with reference to the various aspects and features shown in FIGS. 4-8 of the drawings; such reference is being provided purely by way of explanation and clarification.

The method 700 begins at block 701 by receiving (e.g., via an input device such as touch screen 18, bill validator 22, information reader/writer 24, etc.) an indication of a wager to play a wagering game. At block 703, an outcome of the wagering game is randomly determined. This may include, as indicated above, an RNG generating a random number, game logic for determining the outcome based on the randomly generated number, and the CPU 30, the external system 48, or both, in alternative embodiments, operating to execute a wagering game program, and game assets (e.g., art, sound, etc.) for presenting the determined outcome to a player in a visual manner. As indicated above, the randomly determined outcome may be a complete "final" game outcome or may be a portion or partial game outcome. In either case, the outcome of the wagering game is visually represented by a plurality of symbols arranged on a display device, such as the symbol array 532 of FIG. 5 or the hand of cards in FIG. 8.

At block 705, the method 700 displays a portion of the final outcome to the first player and temporarily suspends play of the wagering game. Block 707 includes a determination of whether to transmit the partial outcome to one or more additional players. As indicated above, this determination can be responsive to a triggering event during play of the wagering game, can require meeting certain eligibility requirements, could be automated, may require an input from the first player, may require an input from each of the additional players, may be responsive to the partial outcome including a portion a winning outcome but not including any complete winning outcomes, etc. If it is determined that the partial outcome should be transmitted (block 707=Yes), the partial outcome is distributed to one or more additional players at block 709. If not (block 707=No), the method proceeds to block 719 and the initial player's final outcome is displayed.

With continuing reference to FIG. 9, the method 700 includes, at block 711, determining whether any requests and/or confirmations to participate in the wagering game and complete the partial outcome have been received. Each request may require the additional player meet certain eligibility requirements, may require an active election to participate, and/or may require the submission of a wager from each of the additional players. If no requests and/or confirmations are received (block 711=No), the method proceeds to block 719 and the initial player's final outcome is displayed. Prior to, during or after displaying the initial player's final outcome, the method 700 determines at block 721 if the initial player's final outcome is a winning outcome. If so, block 717 will award an award associated with the winning outcome.

Upon receipt of such requests (block 711=Yes), a final outcome is randomly determined for each of the players at block 713. The final outcome for each additional player is randomly determined separately from the first final outcome; nevertheless, all of the final outcomes stem from or otherwise include the distributed partial outcome. Moreover, if block 703 includes a random determination of the final outcome for the first player, block 713 will omit making a duplicative determination for the first final outcome. In this regard, the initial player's final outcome may be displayed prior to receiving any requests from secondary players to participate in the wagering game at block 711, e.g., immediately after transmitting the partial outcome at block 707. Block 715 will determine whether any of the final outcomes includes a winning outcome, and block 717 will award an award associated with any winning outcome. Any of the alternative payout options discussed hereinabove with respect to FIG. 7 can be similarly applied in the algorithm presented in FIG. 9.

In some embodiments, the method 700 includes at least those steps enumerated above. It is also within the scope and spirit of the present invention to omit steps, include additional steps, and/or modify the order presented above. It should be further noted that the method 700 represents a single play of a wagering game. However, it is expected that the method 700 be applied in a systematic and repetitive manner.

Aspects of this disclosure can be implemented, in some embodiments, through a computer-executable program of instructions, such as program modules, generally referred to as software applications or application programs executed by a computer. The software can include, in non-limiting examples, routines, programs, objects, components, and data structures that perform particular tasks or implement particular abstract data types. The software can form an interface to allow a computer to react according to a source of input. The software can also cooperate with other code segments to initiate a variety of tasks in response to data received in conjunction with the source of the received data. The software can be stored on any of a variety of memory media, such as CD-ROM, magnetic disk, bubble memory, and semiconductor memory (e.g., various types of RAM or ROM).

Moreover, aspects of the present disclosure can be practiced with a variety of computer-system and computer-network configurations, including hand-held devices, multiprocessor systems, microprocessor-based or programmable-consumer electronics, minicomputers, mainframe computers, and the like. In addition, aspects of the present disclosure can be practiced in distributed-computing environments where tasks are performed by remote-processing devices that are linked through a communications network. In a distributed-computing environment, program modules can be located in both local and remote computer-storage media including memory storage devices. Aspects of the present disclosure can therefore, be implemented in connection with various hardware, software or a combination thereof, in a computer system or other processing system.

Any of the methods described herein can include machine readable instructions for execution by: (a) a processor, (b) a controller, and/or (c) any other suitable processing device. Any algorithm, software, or method disclosed herein can be embodied in software stored on a tangible medium such as, for example, a flash memory, a CD-ROM, a floppy disk, a hard drive, a digital versatile disk (DVD), or other memory devices, but persons of ordinary skill in the art will readily appreciate that the entire algorithm and/or parts thereof could alternatively be executed by a device other than a controller and/or embodied in firmware or dedicated hardware in a well-known manner (e.g., it can be implemented by an application specific integrated circuit (ASIC), a programmable logic device (PLD), a field programmable logic device (FPLD), discrete logic, etc.). Also, some or all of the machine readable instructions represented in any flowchart depicted herein can be implemented manually. Further, although specific algorithms are described with reference to flowcharts depicted herein, persons of ordinary skill in the art will readily appreciate that many other methods of implementing the example machine readable instructions can alternatively be used. For example, the order of execution of the blocks can be changed, and/or some of the blocks described can be changed, eliminated, or combined.

It should be noted that the algorithms illustrated and discussed herein as having various modules or blocks or steps that perform particular functions and interact with one another are provided purely for the sake of illustration and explanation. It should be understood that these modules are merely segregated based on their function for the sake of description and represent computer hardware and/or executable software code which can be stored on a computer-readable medium for execution on appropriate computing hardware. The various functions of the different modules and units can be combined or segregated as hardware and/or software stored on a non-transitory computer-readable medium as above as modules in any manner, and can be used separately or in combination.

Some additional options and features that could be incorporated into any of the above-described wagering games can include: (1) setting up a side wager between the participating players of the FINISH MY GAME feature based on each player's final outcome—e.g., wager on who will be the first player to hit a winning outcome; wager on who will be the player with the highest paying final outcome, etc.; (2) setting up a tournament between the participating players of the FINISH MY GAME feature—e.g., each player submits an entry fee and competes to see who can achieve, within a predetermined number of plays, the highest paying final outcome or total payout; and (3) a hot potato variation of the FINISH MY GAME feature, where the partial outcome is "passed around" a group of additional players until one achieves a winning outcome.

While many preferred embodiments and best modes for carrying out the present invention have been described in detail above, those familiar with the art to which this invention relates will recognize various alternative designs and embodiments for practicing the invention within the scope of the appended claims.

What is claimed is:

1. A gaming system for playing a wagering game, the gaming system comprising:

a cabinet configured to house electronic components operable for conducting the wagering game;

at least one electronic input device coupled to the cabinet and configured to receive a physical input from a first player to initiate the wagering game and transform the physical input into an electronic data signal;

at least one electronic display device coupled to the cabinet and operable to display aspects of the wagering game;

at least one electronic random element generator configured to generate one or more random elements associated with play of the wagering game;

at least one processor; and at least one memory device storing instructions which cause the at least one processor to operate with the at least one electronic display device and the at least one electronic input device to:

initiate the wagering game in response to the electronic data signal generated by the at least one electronic input device in response to the physical input from the first player;

determine a partial outcome of the wagering game based, at least in part, on the one or more random elements generated by the at least one electronic random element generator;

display, via the at least one electronic display device, the randomly determined partial outcome of the wagering game to the first player;

in response to a triggering event in the wagering game, transmit the randomly determined partial outcome to at least one second player;

randomly determine a first final outcome of the wagering game for the first player, the first final outcome including the partial outcome;

randomly determine a second final outcome of the wagering game for the at least one second player, the second final outcome including the partial outcome; and if at least one of the first and second final outcomes is a winning outcome, award to the first player an award associated with the winning outcome.

2. The gaming system of claim 1, wherein the randomly determined partial outcome of the wagering game includes a portion of a predetermined winning outcome.

3. The gaming system of claim 2, wherein the predetermined winning outcome is a start-bonus outcome.

4. The gaming system of claim 3, wherein, if the second final outcome includes the start-bonus outcome, the at least one processor operates to award a bonus game to each of the first player and the at least one second player, the bonus game awarded to the first player being conducted independently from the bonus game awarded to the at least one second player.

5. The gaming system of claim 1, wherein the partial outcome includes at least one symbol, and the first and second final outcomes each includes the at least one symbol and at least one respective additional symbol.

6. The gaming system of claim 1, wherein the at least one processor operates with the at least one electronic display device to display the partial outcome, but not the first and second final outcomes, to the first player prior to transmitting the partial outcome to the at least one second player, and to display the first and second final outcomes after transmitting the partial outcome to the at least one second player.

7. The gaming system of claim 1, wherein the at least one second player to whom the partial outcome is transmitted is determined by displayed indicia in the partial outcome.

8. The gaming system of claim 1, wherein, if the second final outcome is a winning outcome, the at least one processor operates to award the award to both the first player and the at least one second player.

9. The gaming system of claim 1, wherein the transmitting the partial outcome to the at least one second player is at least partially in response to the partial outcome including a portion of a predetermined winning outcome but not including any complete winning outcomes.

10. The gaming system of claim 1, wherein the transmitting the partial outcome to the at least one second player is at least partially responsive to a command received from the first player.

11. The gaming system of claim 1, wherein the transmitting the partial outcome to the at least one second player is at least partially responsive to a triggering event in the partial outcome of the wagering game.

12. The gaming system of claim 1, wherein the displaying the partial outcome is responsive to a first wager received from the first player, and the transmitting the partial outcome to the at least one second player is responsive to a second wager further to the first wager received from the first player after the displaying the partial outcome.

13. The gaming system of claim 1, wherein the randomly determining the second final outcome is at least partially in response to an additional wager received from the at least one second player after the transmitting the randomly determined partial outcome.

14. The gaming system of claim 1, wherein the transmitting the partial outcome to the at least one second player includes posting the partial wagering game outcome on a social networking website, the at least one second player being within a social network of the first player as defined at the social networking website.

15. The gaming system of claim 1, wherein the transmitting the partial outcome is to a plurality of additional players, the first player and the plurality of additional players all being members of a designated group of a social networking website.

16. A method of conducting a wagering game on a gaming system with at least one electronic input device configured to receive physical inputs from players and transform the physical inputs into electronic data signals, at least one electronic display device configured to display outcomes of the wagering game, at least one electronic random element generator configured to generate random elements associated with play of the wagering game, and at least one processor, the method comprising:

receiving, via the at least one electronic input device, a physical input from a first player as an indication of a wager;

initiating, via the at least one processor, the wagering game in response to an electronic data signal generated by the at least one electronic input device responsive to the physical input of the wager from the first player;

determining, via the at least one processor, a partial outcome of the wagering game based, at least in part, on one or more random elements generated by the at least one electronic random element generator, the partial outcome being randomly determined from a plurality of available wagering-game outcomes;

displaying, via the at least one electronic display device, the randomly determined partial outcome of the wagering game to the first player;

in response to a triggering event in the wagering game, transmitting the randomly determined partial outcome to at least one second player;

randomly determining a first final outcome of the wagering game for the first player, the first final outcome including the partial outcome;

randomly determining a second final outcome of the wagering game for the at least one second player, the second final outcome including the partial outcome; and if at least one of the first and second final outcomes is a winning outcome, awarding to the first player an award associated with the winning outcome.

17. A gaming system for playing a wagering game, the gaming system comprising:

a cabinet for housing electronic components operable for conducting the wagering game;

at least one electronic input device configured to receive one or more physical inputs and transform the one or more physical inputs into one or more electronic data signals;

at least one electronic display device operable to display one or more aspects of the wagering game;

at least one electronic random element generator configured to generate one or more random elements associated with play of the wagering game;

at least one processor; and at least one memory device storing instructions which, when executed by the at least one processor, cause the gaming system to:

receive, via the at least one electronic input device, a physical input indicative of a first wager from a first player to play the wagering game;

initiate the wagering game in response to an electronic data signal generated by the at least one electronic input device in response to the physical input from the first player;

determine a first outcome of the wagering game based, at least in part, on one or more random elements generated by the at least one electronic random element generator;

direct the at least one electronic display device to display a portion of the first outcome of the wagering game, the first outcome being randomly determined from a plurality of possible game outcomes and being represented by a first plurality of symbols, the displayed portion of the first outcome including some but not all of the first plurality of symbols;

in response to the displayed portion of the first outcome including at least a portion of a winning symbol combination but not including any complete winning symbol combinations, and prior to displaying all of the first outcome, transmit the portion of the first outcome to a plurality of additional players with an option to complete the portion as part of a separate outcome of the wagering game;

in response to at least one of the additional players electing to complete the portion of the first outcome, randomly determine a second outcome of the wagering game, the second outcome being represented by a second plurality of symbols including the symbols of the portion of the first outcome; and in response to at least one of the first and second outcomes including the winning symbol combination, award to the first player at least a portion of an award associated with the winning symbol combination.

18. The gaming system of claim 17, wherein the transmitting the portion of the first outcome to the additional players is responsive to a command received from the first player.

19. The gaming system of claim 17, wherein the transmitting the portion of the first outcome to the plurality of additional players is responsive to a triggering event in the first outcome of the wagering game.

20. The gaming system of claim 17, wherein the transmitting the portion of the first outcome to the plurality of additional players is responsive to a second wager from the first player further to the first wager received from the first player.

21. The gaming system of claim 17, wherein the transmitting the portion of the first outcome to the plurality of additional players includes posting the portion of the first outcome on a social networking website.

22. The gaming system of claim 17, wherein the randomly determining the second outcome of the wagering game is at least partially in response to an additional wager from the at least one additional player further to the electing to complete the portion of the first outcome.

23. A computer-implemented method of conducting a wagering game on a gaming system with at least one electronic input device configured to receive physical inputs from players and transform the physical inputs into electronic data signals, at least one electronic display device configured to display outcomes of the wagering game, at least one electronic random element generator configured to generate random elements associated with play of the wagering game, and at least one processor, the method comprising:

receiving, via the at least one electronic input device, a physical input from a first player as an indication of a wager;

initiating, via the at least one processor, the wagering game in response to an electronic data signal generated by the at least one electronic input device responsive to the physical input from the first player;

determining, via the at least one processor, a first outcome of the wagering game based, at least in part, on one or more random elements generated by the at least one electronic random element generator, the first outcome being randomly determined from a plurality of possible game outcomes and being represented by a first plurality of symbols;

displaying, via the at least one electronic display device, a portion of the first outcome of the wagering game, the displayed portion including some but not all of the first plurality of symbols;

in response to the displayed portion of the first outcome including at least a portion of a winning symbol combination but not including any complete winning symbol combinations, and prior to displaying all of the first outcome, transmitting the portion of the first outcome to a plurality of additional players with an option to complete the portion as part of a separate outcome of the wagering game;

in response to at least one of the additional players electing to complete the portion of the first outcome, randomly determining a second outcome of the wagering game, the second outcome being represented by a second plurality of symbols including the symbols of the portion of the first outcome; and in response to at least one of the first and second outcomes includes the winning symbol combination, awarding to the first player at least a portion of an award associated with the winning symbol combination.

24. An electronic gaming machine dedicated to playing a wagering game, the electronic gaming machine comprising:

a cabinet housing electronic components operable for conducting the wagering game;

one or more electronic input devices mounted on the cabinet and configured to receive one or more physical inputs from players and transform the one or more physical inputs into one or more electronic data signals;

one or more electronic display devices mounted on the cabinet and operable to display aspects of the wagering game;

one or more electronic random element generators mounted in the cabinet and configured to generate one or more random elements associated with play of the wagering game;

one or more processors mounted in the cabinet; and one or more memory devices storing instructions which, when executed by at least one of the one or more processors, cause the electronic gaming machine to:

receive, via at least one of the one or more electronic input devices, a physical input from a player to initiate the wagering game;

initiate, via at least one of the one or more processors, the wagering game in response to an electronic data signal generated by the at least one electronic input device in response to the physical input from the first player;

determine at least part of a first outcome of the wagering game based, at least in part, on one or more random elements generated by at least one of the one or more electronic random element generators;

display, via at least one of the one or more electronic display devices, only a portion of the first outcome of the wagering game to the first player;

in response to a triggering event during display of the portion of the first outcome of the wagering game, transmit the randomly determined partial outcome to a second player;

randomly determine a second outcome of the wagering game for the second player, the second outcome including the portion of the first outcome;

after transmitting the randomly determined partial outcome to the second player, display the first outcome and the second outcome of the wagering game to the first player; and if the first outcome or the second outcome includes a winning symbol combination, transmit to the first player an award associated with the winning symbol combination.

* * * * *